US009470996B2

(12) United States Patent
Yamauchi et al.

(10) Patent No.: US 9,470,996 B2
(45) Date of Patent: Oct. 18, 2016

(54) TONER, METHOD OF MANUFACTURING THE TONER, AND DEVELOPER, IMAGE FORMING APPARATUS, IMAGE FORMING METHOD, AND PROCESS CARTRIDGE USING THE TONER

(71) Applicants: Yoshitaka Yamauchi, Shizuoka (JP); Kazumi Suzuki, Shizuoka (JP)

(72) Inventors: Yoshitaka Yamauchi, Shizuoka (JP); Kazumi Suzuki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/619,345

(22) Filed: Feb. 11, 2015

(65) Prior Publication Data

US 2015/0253688 A1 Sep. 10, 2015

(30) Foreign Application Priority Data

Mar. 6, 2014 (JP) ..... 2014-043984

(51) Int. Cl.
*G03G 9/093* (2006.01)

(52) U.S. Cl.
CPC ..... *G03G 9/09328* (2013.01); *G03G 9/093* (2013.01); *G03G 9/09371* (2013.01); *G03G 9/09392* (2013.01)

(58) Field of Classification Search
CPC ..... G03G 9/09307
See application file for complete search history.

(56) References Cited

U.S. PATENT DOCUMENTS

| | | | | |
|---|---|---|---|---|
| 4,954,412 | A * | 9/1990 | Breton | G03G 9/09392 430/110.2 |
| 2011/0318053 | A1 | 12/2011 | Yamashita et al. | |
| 2012/0295188 | A1 | 11/2012 | Nakajima et al. | |
| 2012/0322005 | A1 | 12/2012 | Tanaka et al. | |
| 2013/0017480 | A1 | 1/2013 | Suzuki et al. | |
| 2013/0065172 | A1 | 3/2013 | Moriya et al. | |
| 2013/0149642 | A1 | 6/2013 | Sabu et al. | |
| 2013/0157183 | A1 | 6/2013 | Santo et al. | |
| 2013/0171550 | A1 | 7/2013 | Amemori et al. | |
| 2013/0196263 | A1 | 8/2013 | Asahina et al. | |
| 2013/0196266 | A1 | 8/2013 | Watanabe et al. | |
| 2013/0202996 | A1 | 8/2013 | Yamauchi et al. | |
| 2013/0236826 | A1 | 9/2013 | Makabe et al. | |
| 2013/0244167 | A1 | 9/2013 | Yamashita et al. | |
| 2013/0330522 | A1 | 12/2013 | Suzuki et al. | |
| 2014/0080047 | A1 | 3/2014 | Takahashi et al. | |
| 2014/0080050 | A1 | 3/2014 | Asahina et al. | |
| 2014/0272690 | A1 | 9/2014 | Suzuki et al. | |

FOREIGN PATENT DOCUMENTS

| | | |
|---|---|---|
| JP | 2003-167384 | 6/2003 |
| JP | 2005-215298 | 8/2005 |
| JP | 2012-008354 | 1/2012 |
| JP | 2012-155121 | 8/2012 |

* cited by examiner

*Primary Examiner* — Hoa V Le
(74) *Attorney, Agent, or Firm* — Oblon, McClelland, Maier & Neustadt, L.L.P.

(57) ABSTRACT

A toner is provided. The toner includes a core particle, a second shell layer overlying the core particle, and a first shell layer overlying the second shell layer and constituting an outermost layer. The second shell layer includes a crystalline resin, and the first shell layer includes an amorphous resin.

10 Claims, 4 Drawing Sheets

TONER, METHOD OF MANUFACTURING THE TONER, AND DEVELOPER, IMAGE FORMING APPARATUS, IMAGE FORMING METHOD, AND PROCESS CARTRIDGE USING THE TONER

CROSS-REFERENCE TO RELATED APPLICATIONS

This patent application is based on and claims priority pursuant to 35 U.S.C. §119(a) to Japanese Patent Application No. 2014-043984, filed on Mar. 6, 2014, in the Japan Patent Office, the entire disclosure of which is hereby incorporated by reference herein.

BACKGROUND

1. Technical Field

The present disclosure relates to a toner, a method of manufacturing the toner, and a developer, an image forming apparatus, an image forming method, and a process cartridge using the toner.

2. Description of the Related Art

Electrophotographic image forming process generally includes forming an electrostatic latent image on a photoconductor serving as a latent image bearer, developing the electrostatic latent image into a toner image with a developer, transferring the toner image onto a recording medium such as paper, and fixing the toner image on the recording medium.

The developer is of two types: one-component developer consisting primarily of a magnetic or non-magnetic toner and two-component developer consisting primarily of a toner and a carrier. In fixing the toner image, a method called heat roller method is widely used owing to its high energy efficiency. In the heat roller method, a heat roller directly presses against the toner image on the recording medium. However, the heat roller method has a problem that a large amount of electric power is required for fixing the toner image. Accordingly, toner is required to more improve low-temperature fixability.

Many attempts have been made to improve low-temperature fixability of toner. For example, JP-2003-167384-A proposes a toner including a colorant, a release agent, and two types of binder resins: polyester resins A and B. The polyester resin A is a crystalline aliphatic polyester resin having a specific X-ray diffraction pattern, and the polyester resin B is an amorphous polyester resin having a softening point higher than that of the polyester resin A. The polyester resins A and B are incompatible with each other. It is described therein that this toner has good low-temperature fixability and hot offset resistance.

JP-2012-8354-A proposes a method of manufacturing a specific toner which has crystalline organic particles on its surface. It is described therein that this toner can be transferred from a photoconductor onto an intermediate transfer medium, further onto an image support, at a high transfer efficiency, without causing image defect, providing image with high reproducibility for an extended period of time.

JP-2012-155121-A proposes a core-shell toner including a core particle containing a binder resin and a colorant and a shell layer on the surface of the core particle. It is described therein that this toner prevents the emergence of color points.

SUMMARY

In accordance with some embodiments of the present invention, a toner is provided. The toner includes a core particle, a second shell layer overlying the core particle, and a first shell layer overlying the second shell layer and constituting an outermost layer. The second shell layer includes a crystalline resin, and the first shell layer includes an amorphous resin.

In accordance with some embodiments of the present invention, a developer is provided. The developer includes the above toner and a carrier.

In accordance with some embodiments of the present invention, a method of manufacturing the above toner is provided. The method includes the steps of: (I) dissolving or dispersing core materials including at least a binder resin in a solvent, thereby preparing a solution or dispersion liquid of the core materials; (II) subjecting the crystalline resin in a melted state to an emulsification treatment along with a treatment liquid to obtain a crystalline resin particle and diluting the crystalline resin particle with a solvent including water, thereby preparing an aqueous phase (a); (III) mixing the solution or dispersion liquid of the core materials in the aqueous phase (a), thereby preparing an emulsion slurry (1); (IV) subjecting the amorphous resin in a melted state to an emulsification treatment along with a treatment liquid to obtain an amorphous resin particle and diluting the amorphous resin particle with a solvent including water, thereby preparing an aqueous phase (b); (V) mixing the emulsion slurry (1) in the aqueous phase (b) and subjecting the mixture to a solvent removal treatment under reduced pressures, thereby preparing a solvent-free slurry (2); and (VI) heating the solvent-free slurry (2) to fix the crystalline resin particle and the amorphous resin particle on the core particle.

In accordance with some embodiments of the present invention, another method of manufacturing the above toner is provided. The method includes the steps of: (I) subjecting the amorphous resin in a melted state to an emulsification treatment along with a treatment liquid to obtain an amorphous resin particle and diluting the amorphous resin particle with a solvent including water, thereby preparing an amorphous resin particle dispersion liquid (A); (II) subjecting the crystalline resin in a melted state to an emulsification treatment along with a treatment liquid to obtain a crystalline resin particle and diluting the crystalline resin particle with a solvent including water, thereby preparing a crystalline resin particle dispersion liquid (B); (III) dispersing a wax in a water with a surfactant, thereby preparing a wax dispersion liquid; (IV) heat-mixing the amorphous resin particle dispersion liquid (A) and the wax dispersion liquid, thereby preparing a core particle dispersion liquid containing the core particle having a desired particle diameter; (V) mixing the crystalline resin particle dispersion liquid (B) in the core particle dispersion liquid; (VI) mixing the amorphous resin particle dispersion liquid (A) in the mixture obtained in the process (V); (VII) subjecting the mixture obtained in the process (VI) to a solvent removal treatment under reduced pressures, thereby preparing a solvent-free slurry (2); and (VIII) heating the solvent-free slurry (2) to fix the crystalline resin particle and the amorphous resin particle on the core particle.

In accordance with some embodiments of the present invention, an image forming apparatus is provided. The image forming apparatus includes a latent image bearer, a charger, an irradiator, a developing device, a transfer device, and a fixing device. The charger charges a surface of the latent image bearer. The irradiator irradiates the charged surface of the latent image bearer with light to form an electrostatic latent image thereon. The developing device develops the electrostatic latent image into a toner image with the above toner. The transfer device transfers the toner image from the surface of the latent image bearer onto a recording medium. The fixing device fixed the toner image on the recording medium.

In accordance with some embodiments of the present invention, an image forming method is provided. The method includes the steps of: charging a surface of a latent image bearer; irradiating the charged surface of the latent image bearer with light to form an electrostatic latent image thereon; developing the electrostatic latent image into a toner image with the above toner; transferring the toner image from the surface of the latent image bearer onto a recording medium; and fixing the toner image on the recording medium.

In accordance with some embodiments of the present invention, a process cartridge detachably mountable on image forming apparatus is provided. The process cartridge includes a latent image bearer and a developing device. The latent image bearer bears an electrostatic latent image. The developing device develops the electrostatic latent image into a toner image with the above toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
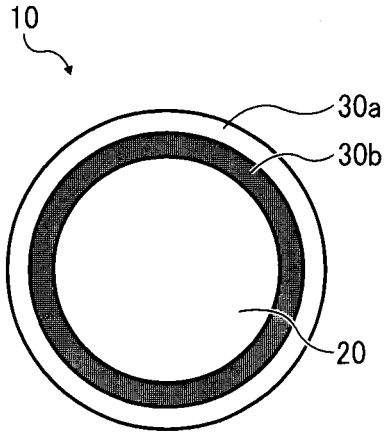
FIG. 1 is a schematic cross-sectional view of a toner according to some embodiments of the present invention.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

Within the context of the present disclosure, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

The toners described in JP-2012-8354-A and JP-2012-155121-A are core-shell toners, the shell layer of each of which includes a crystalline polyester to improve low-temperature fixability. Although having an improved low-temperature fixability, these toners have a problem that toner scattering and background fouling are likely to occur due to defective charging of the toner that is caused because the crystalline polyester is exposed at the shell layer that is the outermost layer.

In view of this situation, one object of the present invention is to provide a toner which has excellent low-temperature fixability and does not cause toner scattering and background fouling.

In accordance with some embodiments of the present invention, a toner which has excellent low-temperature fixability and does not cause toner scattering and background fouling is provided.

The toner according to some embodiments of the present invention includes a core particle, a second shell layer overlying the core particle, and a first shell layer overlying the second shell layer and constituting an outermost layer. The second shell layer includes a crystalline resin, and the first shell layer includes an amorphous resin.

The crystalline resin causes crystal transformation at the melting point. Simultaneously, the crystalline resin in a solid state rapidly decreases in melt viscosity and expresses a function to be fixed on a recording medium. The amorphous resin gradually decreases in melt viscosity from the glass transition temperature. There is a several tens degrees of difference between the glass transition temperature and a temperature at which the melt viscosity decreases to the extent that a function to be fixed on a recording medium is expressed, such as the softening point.

Accordingly, to improve low-temperature fixability of a toner which includes an amorphous resin and no crystalline resin, the softening point of the amorphous resin should be decreased by decreasing the glass transition temperature and/or molecular weight. However, this approach will degrade heat-resistant storage stability and hot offset resistance of the toner. To improve low-temperature fixability without degrading heat-resistant storage stability and hot offset resistance, it is advantageous to combine a crystalline resin and an amorphous resin. When a crystalline resin and an amorphous resin are used in combination, these resins can be phase-separated in the toner. In this case, the toner has excellent low-temperature fixability and does not cause toner scattering and background fouling.

In a toner in which a crystalline resin and an amorphous resin are phase-separated, each of the crystalline and amorphous resins can independently express its function. The amorphous resin has a function of preventing the occurrence of toner scattering and background fouling. The crystalline resin has a function of improving low-temperature fixability.

The toner according to some embodiments of the present invention is a core-shell toner having two shell layers overlying a core particle.

FIG. 1 is a schematic cross-sectional view of a toner according to some embodiments of the present invention. Referring to FIG. 1, a toner 10 includes a core particle 20, a second shell layer 30*b* including a crystalline resin, and a first shell layer 30*a* including an amorphous resin. The second shell layer 30*b* is overlying the core particle 20. The first shell layer 30*b* is overlying the second shell layer 30*b* and constituting the outermost layer.

The second shell layer 30*b*, including a crystalline resin, is overlying the core particle 20, so the toner has an improved low-temperature fixability. The first shell layer 30*a*, including an amorphous resin, is overlying the second shell layer 30*b*, so the occurrence of toner scattering and background fouling are prevented, which might occur if the crystalline resin is exposed at the outermost layer to cause defective charging or resistivity decrease.

The first layer including an amorphous resin preferably has an average thickness of less than 100 nm. When the average thickness is 100 nm or more, low-temperature fixability will decrease.

Preferably, the crystalline resin is a crystalline polyester. Preferably, the amorphous resin is an amorphous polyester. Each of the crystalline and amorphous resins independently expresses its function owing to the two-layered shell structure. Thus, the occurrence of toner scattering and background fouling are prevented while low-temperature fixability is improved.

Crystalline Resin

Specific examples of the crystalline resin include, but are not limited to, crystalline polyester, crystalline polyurethane, crystalline polyurea, crystalline polyamide, crystalline polyether, crystalline vinyl resin, crystalline urethane-modified polyester, and crystalline urea-modified polyester. Two or more of these resins can be used in combination. Among these resins, a crystalline resin having urethane bond and/or urea bond in its main chain is preferable.

Such a crystalline resin having urethane bond and/or urea bond in its main chain is incompatible with the amorphous resin, and therefore a sea-island structure is formed. The crystalline resin having urethane bond and/or urea bond in its main chain generally has a higher hardness owing to the existence of urethane bond and/or urea bond. Thus, the toner composition is likely to fracture at the amorphous resin portion existing between the crystalline resin portions. In the resulting toner, the crystalline resin will exist near the surface of the toner but the surface itself will be covered with the amorphous resin.

Specific examples of the crystalline resin having urethane bond and/or urea bond in its main chain include, but are not limited to, crystalline polyurethane, crystalline polyurea, crystalline urethane-modified polyester, and crystalline urea-modified polyester.

The crystalline urethane-modified polyester can be prepared by introducing isocyanate group to a terminal of a crystalline polyester and then reacting the crystalline polyester with a polyol.

The crystalline urea-modified polyester can be prepared by introducing isocyanate group to a terminal of a crystalline polyester and then reacting the crystalline polyester with a polyamine.

The crystalline polyester can be prepared by, for example: a polycondensation of a polyol with a polycarboxylic acid; a ring-opening polymerization of a lactone; a polycondensation of a hydroxycarboxylic acid; or a ring-opening polymerization of a cyclic ester having 4 to 12 carbon atoms which is equivalent to a dehydration condensation product among two or three molecules of a hydroxycarboxylic acid. In particular, a polycondensation of a diol with a dicarboxylic acid is preferable.

As the polyol, a diol alone or a combination of a diol with an alcohol having 3 or more valences can be used.

Specific examples of the diol include, but are not limited to, aliphatic diols such as straight-chain aliphatic diols and branched aliphatic diols; alkylene ether glycols having 4 to 36 carbon atoms; alicyclic diols having 4 to 36 carbon atoms; alkylene oxide (e.g., ethylene oxide, propylene oxide, butylene oxide) 1 to 30 mol adducts of alicyclic diols having 4 to 36 carbon atoms; alkylene oxide (e.g., ethylene oxide, propylene oxide, butylene oxide) 2 to 30 mol adducts of bisphenols; polylactonediols; polybutadienediols; and diols having a functional group such as carboxyl group, sulfonic acid group, and sulfamic acid group, and salts thereof. Two or more of these diols can be used in combination. In particular, aliphatic diols having 2 to 36 carbon atoms in its main chain are preferable, and straight-chain aliphatic diols having 2 to 36 carbon atoms in its main chain are more preferable.

The diol preferably includes a straight-chain aliphatic diol in an amount of 80% by mol or more, more preferably 90% by mol or more. When the content of the straight-chain aliphatic diol in the diol is less than 80% by mol, it may be difficult for the toner to achieve a good balance between low-temperature fixability and heat-resistant storage stability.

Specific examples of the straight-chain aliphatic diols having 2 to 36 carbon atoms in its main chain include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among these compounds, ethylene glycol, 1,3-propanediol, 1,4-butanediol, 1,6-hexanediol, 1,9-nonanediol, and 1,10-decanediol are preferable.

Specific examples of branched aliphatic diols having 2 to 36 carbon atoms in its main chain include, but are not limited to, 1,2-propylene glycol, butanediol, hexanediol, octanediol, decanediol, dodecanediol, tetradecanediol, neopentyl glycol, and 2,2-diethyl-1,3-propanediol.

Specific examples of the alkylene ether glycols having 4 to 36 carbon atoms include, but are not limited to, diethylene glycol, triethylene glycol, dipropylene glycol, polyethylene glycol, polypropylene glycol, and polytetramethylene ether glycol.

Specific examples of the alicyclic diols having 4 to 36 carbon atoms include, but are not limited to, 1,4-cyclohexanedimethanol and hydrogenated bisphenol A.

Specific examples of the bisphenols include, but are not limited to, bisphenol A, bisphenol F, and bisphenol S.

Specific examples of the polylactonediols include, but are not limited to, poly(ε-caprolactonediol).

Specific examples of the diols having carboxyl group include, but are not limited to, dialkylol alkanoic acids having 6 to 24 carbon atoms, such as 2,2-dimethylol propionic acid, 2,2-dimethylol butanoic acid, 2,2-dimethylol heptanoic acid, and 2,2-dimethylol octanoic acid.

Specific examples of the diols having sulfonic acid group or sulfamic acid group include, but are not limited to, N,N-bis(2-hydroxyethyl)sulfamic acid; alkylene oxide (e.g., ethylene oxide, propylene oxide, butylene oxide) 1 to 6 mol adducts of N,N-bis(2-hydroxyalkyl(C1-C6))sulfamic acid, such as propylene oxide 2 mol adduct of N,N-bis(2-hydroxyethyl)sulfamic acid; and bis(2-hydroxyethyl)phosphate.

Specific examples of bases for neutralizing salts in the diols having carboxyl group, sulfonic acid group, or sulfamic acid group include, but are not limited to, tertiary amines having 3 to 30 carbon atoms such as triethylamine, and hydroxides of alkali metals such as sodium hydroxide.

Among these diols, alkylene glycols having 2 to 12 carbon atoms, diols having carboxyl group, and alkylene oxide adducts of bisphenols are preferable.

Specific examples of the alcohol having 3 or more valences include, but are not limited to, alkanepolyols, such as glycerin, trimethylolethane, trimethylolpropane, pentaerythritol, sorbitol, sorbitan, and polyglycerin, and intramolecular or intermolecular dehydration products thereof; polyvalent aliphatic alcohols having 3 to 36 carbon atoms such as sugars (e.g., sucrose, methyl glucoside) and derivatives thereof; alkylene oxide 2 to 30 mol adducts of trisphenols such as trisphenol PA; alkylene oxide 2 to 30 mol adducts of novolac resins such as phenol novolac and cresol novolac; and acrylic polyols such as copolymers of hydroxyethyl acrylate or methacrylate with other vinyl monomers. Among these polyols, polyvalent aliphatic alcohols having 3 or more valences and alkylene oxide adducts of novolac resins are preferable; and alkylene oxide adducts of novolac resins are more preferable.

As the polycarboxylic acid, a dicarboxylic acid alone or a combination of a dicarboxylic acid with a carboxylic acid having 3 or more valences can be used.

Specific examples of the dicarboxylic acid include, but are not limited to, aliphatic dicarboxylic acids such as straight-chain aliphatic dicarboxylic acids and branched aliphatic dicarboxylic acids, and aromatic dicarboxylic acids. Among these compounds, straight-chain aliphatic dicarboxylic acids are preferable.

Specific examples of the aliphatic dicarboxylic acids include, but are not limited to, alkane dicarboxylic acids having 4 to 36 carbon atoms such as succinic acid, adipic acid, sebacic acid, azelaic acid, dodecane dicarboxylic acid, octadecane dicarboxylic acid, and decyl succinic acid; alkenyl succinic acids such as dodecenyl succinic acid, pentadecenyl succinic acid, and octadecenyl succinic acid; alkene dicarboxylic acids having 4 to 36 carbon atoms such as maleic acid, fumaric acid, and citraconic acid; and alicyclic dicarboxylic acids having 6 to 40 carbon atoms such as dimmer acid (dimeric linoleic acid).

Specific examples of the aromatic dicarboxylic acids include, but are not limited to, aromatic dicarboxylic acids having 8 to 36 carbon atoms such as phthalic acid, isophthalic acid, terephthalic acid, t-butyl isophthalic acid, 2,6-naphthalenedicarboxylic acid, and 4,4'-biphenyl dicarboxylic acid.

Specific examples of the carboxylic acid having 3 or more valences include, but are not limited to, aromatic polycarboxylic acids having 9 to 20 carbon atoms such as trimellitic acid and pyromellitic acid.

In place of the polycarboxylic acid, an anhydride or an alkyl ester having 1 to 4 carbon atoms, such as methyl ester, ethyl ester, and isopropyl ester, of the polycarboxylic acid can be used.

Among these compounds, a single use of an aliphatic dicarboxylic acid is preferable; and a single use of adipic acid, sebacic acid, dodecane dicarboxylic acid, terephthalic acid, or isophthalic acid is more preferable. In addition, a combination use of an aliphatic dicarboxylic acid with an aromatic dicarboxylic acid is also preferable; and a combination use of an aliphatic dicarboxylic acid with terephthalic acid, isophthalic acid, or t-butyl isophthalic acid is more preferable.

The polycarboxylic acid preferably includes an aromatic dicarboxylic acid in an amount 20% by mol or less.

Specific examples of the lactone include, but are not limited to, monolactones having 3 to 12 carbon atoms such as β-propiolactone, γ-butyrolactone, δ-valerolactone, and ϵ-caprolactone. Among these compounds, ϵ-caprolactone is preferable.

In a ring-opening polymerization of the lactone, catalysts (e.g., metal oxides, organic metal compounds) and/or initiators (e.g., diols such as ethylene glycol and diethylene glycol) can be used.

Specific examples of commercially-available ring-opening polymerization products of the lactone include, but are not limited to, PLACCEL H1P, H4, H5, and H7 (available from Daicel Corporation).

Specific examples of the hydroxycarboxylic acid to be subjected to a polycondensation include, but are not limited to, glycolic acid and lactic acid (including L form, D form, racemic form, etc.).

Specific examples of the hydroxycarboxylic acid for preparing the cyclic ester include, but are not limited to, glycolide and lactide (including L form, D form, racemic form, etc.). Among these compounds, L-lactide and D-lactide are preferable.

In a ring-opening polymerization of the cyclic ester, catalysts such as metal oxides and organic metal compounds can be used.

By modifying a polycondensation product of the hydroxycarboxylic acid or a ring-opening polymerization product of the cyclic ester such that hydroxyl group or carboxyl group is introduced to the terminals thereof, a polyester diol or a polyester dicarboxylic acid can be prepared.

The crystalline polyurethane can be prepared by a polyaddition of a polyol to a polyisocyanate. In particular, a polyaddition of a diol to a diisocyanate is preferable.

As the polyol, a diol alone or a combination of a diol with an alcohol having 3 or more valences can be used.

As the polyol, those usable for preparing the crystalline polyester can also be used.

As the polyisocyanate, a diisocyanate alone or a combination of a diisocyanate with an isocyanate having 3 or more valences can be used.

Specific examples of the diisocyanate include, but are not limited to, aromatic diisocyanates, aliphatic diisocyanates, alicyclic diisocyanates, and aromatic aliphatic diisocyanates. In particular, aromatic diisocyanates having 6 to 20 carbon atoms exclusive of those in isocyanate group, aliphatic diisocyanates having 2 to 18 carbon atoms exclusive of those in isocyanate group, alicyclic diisocyanates having 4 to 15 carbon atoms exclusive of those in isocyanate group, aromatic aliphatic diisocyanates having 8 to 15 carbon atoms exclusive of those in isocyanate group, and modified isocyanates having urethane group, carbodiimide group, allophanate group, urea group, biuret group, uretdione group, uretonimine group, isocyanate group, or oxazolidone group, can be used. Two or more of these compounds can be used in combination.

Specific examples of the aromatic diisocyanates include, but are not limited to, 1,3-phenylene diisocyanate, 1,4-phenylene diisocyanate, 2,4-tolylene diisocyanate, 2,6-tolylene diisocyanate, crude tolylene diisocyanate, 2,4'-diphenylmethane diisocyanate, 4,4'-diphenylmethane diisocyanate, crude diphenylmethane diisocyanate (e.g., crude bis(aminophenyl)methane (e.g., a phosgene compound of a mixture or condensation product of formaldehyde and aromatic amine (e.g., aniline); a phosgene compound of a mixture of bis(aminophenyl)methane with a small amount (for example, 5% to 20% by weight) of a tri- or more functional amine)), 1,5-naphthylene diisocyanate, 4,4',4"-triphenylmethane triisocyanate, m-isocyanatophenylsulfonyl isocyanate, and p-isocyanatophenylsulfonyl isocyanate.

Specific examples of the aliphatic diisocyanates include, but are not limited to, ethylene diisocyanate, tetramethylene diisocyanate, hexamethylene diisocyanate, dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, and 2-isocyanatoethyl-2,6-diisocyanatohexanoate.

Specific examples of the alicyclic diisocyanates include, but are not limited to, isophorone diisocyanate, dicyclohexylmethane-4,4'-diisocyanate, cyclohexylene diisocyanate, methylcyclohexylene diisocyanate, bis(2-isocyanatoethyl)-4-cyclohexene-1,2-dicarboxylate, 2,5-norbornane diisocyanate, and 2,6-norbornane diisocyanate.

Specific examples of the aromatic aliphatic diisocyanates include, but are not limited to, m-xylylene diisocyanate, p-xylylene diisocyanate, and α,α,α',α'-tetramethylxylylene diisocyanate.

Specific examples of the modified diisocyanates include, but are not limited to, modified diphenylmethane diisocyanates such as urethane-modified diphenylmethane diisocyanate, carbodiimide-modified diphenylmethane diisocyanate, and trihydrocarbyl-phosphate-modified diphenylmethane diisocyanate; and modified diisocyanates such as urethane-modified tolylene diisocyanates such as a prepolymer having isocyanate group.

Among these compounds, aromatic diisocyanates having 6 to 15 carbon atoms exclusive of those in isocyanate group, aliphatic diisocyanates having 4 to 12 carbon atoms exclusive of those in isocyanate group, and alicyclic diisocyanates having 4 to 15 carbon atoms exclusive of those in isocyanate group are preferable; and tolylene diisocyanate, diphenylmethane diisocyanate, hexamethylene diisocyanate, hydrogenated diphenylmethane diisocyanate, and isophorone diisocyanate are more preferable.

The crystalline polyurea can be prepared by a polyaddition of a polyamine to a polyisocyanate. In particular, a polyaddition of a diamine to a diisocyanate is preferable.

As the polyisocyanate, a diisocyanate alone or a combination of a diisocyanate with an isocyanate having 3 or more valences can be used.

As the polyisocyanate, those usable for preparing the crystalline polyurethane can also be used.

As the polyamine, a diamine alone or a combination of a diamine with an amine having 3 or more valences can be used.

Specific examples of the polyamine include, but are not limited to, aliphatic polyamines and aromatic polyamines. In particular, aliphatic polyamines having 2 to 18 carbon atoms and aromatic polyamines having 6 to 20 carbon atoms are preferable.

Specific examples of the aliphatic polyamines having 2 to 18 carbon atoms include, but are not limited to, alkylenediamines having 2 to 6 carbon atoms such as ethylenediamine, propylenediamine, trimethylenediamine, tetramethylenediamine, and hexamethylenediamine; polyalkylenepolyamines having 4 to 18 carbon atoms such as diethylenetriamine, iminobis(propylamine), bis(hexamethylene)triamine, triethylenetetramine, tetraethylenepentamine, and pentaethylenehexamine; C1-C4 alkyl and C2-C4 hydroxyalkyl substitutes of alkylenediamines and polyalkylenediamines such as dialkylaminopropylamine, trimethylhexamethylenediamine, aminoethylethanolamine, 2,5-dimethyl-2,5-hexamethylenediamine, and methyliminobis(propylamine); alicyclic diamines having 4 to 15 carbon atoms such as 1,3-diaminocyclohexane, isophoronediamine, menthenediamine, and 4,4'-methylenedicyclohexanediamine (hydrogenated methylenedianiline); heterocyclic diamines having 4 to 15 carbon atoms such as piperazine, N-aminoethylpiperazine, 1,4-diaminoethylpiperazine, 1,4-bis(2-amino-2-methylpropyl)piperazine, and 3,9-bis(3-aminopropyl)-2,4,8,10-tetraoxaspiro[5,5]undecane; and aromatic-ring-containing aliphatic diamines having 8 to 15 carbon atoms such as xylylenediamine and tetrachloro-p-xylylenediamine.

Specific examples of the aromatic diamines having 6 to 20 carbon atoms include, but are not limited to, unsubstituted aromatic diamines such as 1,2-phenylenediamine, 1,3-phenylenediamine, 1,4-phenylenediamine, 2,4'-diphenylmethanediamine, 4,4'-diphenylmethanediamine, crude diphenylmethanediamine (polyphenyl polymethylene polyamine), diaminodiphenyl sulfone, benzidine, thiodianiline, bis(3,4-diaminophenyl) sulfone, 2,6-diaminopyridine, m-aminobenzylamine, triphenylmethane-4,4'-4"-triamine, and naphthylenediamine; aromatic diamines having a C1-4 nuclear-substituted alkyl group such as 2,4-tolylenediamine, 2,6-tolylenediamine, crude tolylenediamine, diethyltolylenediamine, 4,4'-diamino-3-3'-dimethyldiphenylmethane, 4,4'-bis(o-tolidine), dianisidine, diaminotolyl sulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diaminodiphenyl ether, and 3,3',5,5'-tetraisopropyl-4,4'-diaminodiphenyl sulfone; aromatic diamines having a nuclear-substituted electron withdrawing group (e.g., a halo group such as chloro group, bromo group, iodo group, and fluoro group; an alkoxy group such as methoxy group and ethoxy group; and nitro group) such as methylenebis(o-chloroaniline), 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline, 4,4'-diamino-3,3'-dimethyl-5,5'-dibromodiphenylmethane, 3,3'-dichlorobenzidine, 3,3'-dimethoxybenzidine, bis(4-amino-3-chlorophenyl) oxide, bis(4-amino-2-chlorophenyl) propane, bis(4-amino-2-chlorophenyl) sulfone, bis(4-amino-3-methoxyphenyl)decane, bis(4-aminophenyl) sulfide, bis(4-aminophenyl) telluride, bis(4-aminophenyl) selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline), and 4-aminophenyl-2-chloroaniline; and aromatic diamines (including unsubstituted aromatic diamines, aromatic diamines having a C1-4 nuclear-substituted alkyl group, and aromatic diamines having a nuclear-substituted electron withdrawing group in which a part of or all of the primary amino groups are substituted with a lower alkyl group such as methyl group and ethyl group) having a secondary amino group such as 4,4'-bis(methylamino)diphenylmethane and 1-methyl-2-methylamino-4-aminobenzene.

In addition, the following diamines can be used: a polyamide polyamine that is a condensation product of a dicarboxylic acid (e.g., dimer acid) with an excessive amount (2 mol or more per 1 mol of the dicarboxylic acid) of a polyamine (e.g., an alkylenediamine, a polyalkylenepolyamine); and a polyether polyamine that is a hydride of a cyanoethylation product of a polyether polyol (e.g., a polyalkylene glycol).

In place of the polyamine, ketimine or oxazoline, each of which is a blocked polyamine in which the amino group is blocked with a ketone (e.g., acetone, methyl ethyl ketone, methyl isobutyl ketone), can be used.

The crystalline polyamide can be prepared by a polycondensation of a polyamine with a polycarboxylic acid. In particular, a polycondensation of a diamine with a dicarboxylic acid is preferable.

As the polyamine, a diamine alone or a combination of a diamine with an amine having 3 or more valences can be used.

As the polyamine, those usable for preparing the crystalline polyurea can also be used.

As the polycarboxylic acid, a dicarboxylic acid alone or a combination of a dicarboxylic acid with a carboxylic acid having 3 or more valences can be used.

As the polycarboxylic acid, those usable for preparing the crystalline polyester can also be used.

Specific examples of the crystalline polyether include, but are not limited to, crystalline polyoxyalkylene polyols.

The crystalline polyoxyalkylene polyol can be prepared by, for example, a ring-opening polymerization of a chiral alkylene oxide using a catalyst (as described in Journal of the American Chemical Society, 1956, Vol. 78, No. 18, p. 4787-4792), or a ring-opening polymerization of a racemic alkylene oxide using a catalyst.

The ring-opening polymerization of a racemic alkylene oxide using a catalyst may be a method using a compound prepared by contacting a lanthanoid complex with an organic aluminum as a catalyst (as described in JP-11-12353-A), or a method in which a bimetal μ-oxoalkoxide is reacted with a hydroxyl compound in advance (as described in JP-2001-521957-A), but is not limited thereto.

A polyoxyalkylene polyol having a very high isotacticity can be prepared by, for example, a method using a salen complex as a catalyst (as described in Journal of the American Chemical Society, 2005, Vol. 127, No. 33, p. 11566-11567). By a ring-opening polymerization of a chiral alkylene oxide using a diol or water as an initiator, a polyoxyalkylene glycol having an isotacticity of 50% or more and terminal hydroxyl group can be obtained. The polyoxyalkylene glycol having an isotacticity of 50% or more can be modified with a dicarboxylic acid such that the terminals are replaced with carboxyl group. Generally, when the isotacticity is equal to or more than 50%, crystallinity is expressed.

As the diol, those usable for preparing the crystalline polyester can also be used. As the dicarboxylic acid, those usable for preparing the crystalline polyester can also be used. Specific examples of the alkylene oxide include, but are not limited to, alkylene oxides having 3 to 9 carbon atoms such as propylene oxide, 1-chlorooxetane, 2-chlorooxetane, 1,2-dichlorooxetane, epichlorohydrin, epibromohydrin, 1,2-butylene oxide, methyl glycidyl ether, 1,2-pentylene oxide, 2,3-pentylene oxide, 3-methyl-1,2-butylene oxide, cyclohexene oxide, 1,2-hexylene oxide, 3-methyl-1,2-pentylene oxide, 2,3-hexylene oxide, 4-methyl-2,3-pentylene oxide, allyl glycidyl ether, 1,2-heptylene oxide, styrene oxide, and phenyl glycidyl ether. Two or more of these compounds can be used in combination. Among these compounds, propylene oxide, 1,2-butylene oxide, styrene oxide, and cyclohexene oxide are preferable; and propylene oxide, 1,2-butylene oxide, and cyclohexene oxide are more preferable.

The crystalline polyoxyalkylene polyol generally has an isotacticity of 70% or more, preferably 80% or more, more preferably 90% or more, and most preferably 95% or more. The isotacticity can be determined by a method described in Macromolecules, Vol. 35, No. 6, 2389-2393 (2002).

The crystalline vinyl resin can be prepared by an addition polymerization of a crystalline vinyl monomer, along with an amorphous vinyl monomer as needed.

Specific examples of the crystalline vinyl monomer include, but are not limited to, alkyl acrylates/methacrylates having a straight-chain alkyl group having 12 to 50 carbon atoms, such as lauryl acrylate/methacrylate, tetradecyl acrylate/methacrylate, stearyl acrylate/methacrylate, eicosyl acrylate/methacrylate, and behenyl acrylate/methacrylate. Two or more of these compounds can be used in combination.

Specific examples of the amorphous vinyl monomer include, but are not limited to, styrenes, acrylates/methacrylates, vinyl monomers having carboxyl group, vinyl esters, and vinyl monomers having a molecular weight of 1,000 or less such as aliphatic hydrocarbon vinyl monomers. Two or more of these compounds can be used in combination.

Specific examples of the styrenes include, but are not limited to, styrene and alkyl styrenes having an alkyl group having 1 to 3 carbon atoms.

Specific examples of the acrylates/methacrylates include, but are not limited to, alkyl acrylates/methacrylates having a straight-chain alkyl group having 1 to 11 carbon atoms, such as methyl acrylate/methacrylate, ethyl acrylate/methacrylate, and butyl acrylate/methacrylate; alkyl acrylates/methacrylates having a branched alkyl group having 12 to 18 carbon atoms, such as 2-ethylhexyl acrylate/methacrylate; hydroxyalkyl acrylates/methacrylates having a hydroxyalkyl group having 1 to 11 carbon atoms, such as hydroxyethyl acrylate/methacrylate; and dialkylaminoalkyl acrylates/methacrylates having a dialkylaminoalkyl group having 1 to 11 carbon atoms, such as dimethylaminoethyl acrylate/methacrylate and diethylaminoethyl acrylate/methacrylate.

Specific examples of the vinyl monomers having carboxyl group include, but are not limited to, monocarboxylic acids having 3 to 15 carbon atoms such as acrylic acid, methacrylic acid, crotonic acid, and cinnamic acid; dicarboxylic acids having 4 to 15 carbon atoms such as maleic acid, maleic anhydride, fumaric acid, itaconic acid, and citraconic acid; and dicarboxylic acid monoalkyl esters having 1 to 18 carbon atoms such as maleic acid monoalkyl esters, fumaric acid monoalkyl esters, itaconic acid monoalkyl esters, and citraconic acid monoalkyl esters.

Specific examples of the vinyl esters include, but are not limited to, aliphatic vinyl esters having 4 to 15 carbon atoms such as vinyl acetate, vinyl propionate, and isopropenyl acetate; unsaturated carboxylic acid polyol esters having 8 to 50 carbon atoms such as ethylene glycol diacrylate/dimethacrylate, propylene glycol diacrylate/dimethacrylate, neopentyl glycol diacrylate/dimethacrylate, trimethylolpropane diacrylate/dimethacrylate, 1,6-hexanediol diacrylate, and polyethylene glycol diacrylate/dimethacrylate; aromatic carboxylic acid vinyl esters having 9 to 15 carbon atoms such as methyl-4-vinyl benzoate.

Specific examples of the aliphatic hydrocarbon vinyl monomers include, but are not limited to, olefins having 2 to 10 carbon atoms such as ethylene, propylene, butene, and octene; and dienes having 4 to 10 carbon atoms such as butadiene, isoprene, and 1,6-hexadiene.

The ratio of the melting point to the softening temperature of the crystalline resin is generally from 0.80 to 1.55, preferably from 0.85 to 1.25, more preferably from 0.90 to 1.20, and most preferably from 0.90 to 1.19. When the ratio of the melting point to the softening temperature of the crystalline resin falls below 0.80, hot offset resistance of the toner will deteriorate. When the ratio exceeds 1.55, low-temperature fixability and heat-resistant storage stability of the toner will deteriorate.

The melting point of the crystalline resin is generally from 60 to 80° C., preferably from 65 to 70° C. When the melting point of the crystalline resin falls below 60° C., heat-resistant storage stability of the toner may deteriorate. When the melting point of the crystalline resin exceeds 80° C., low-temperature fixability of the toner may deteriorate.

The melting point can be measured by a differential scanning calorimeter TA-60WS or DSC-60 (from Shimadzu Corporation). The softening temperature can be measured by a capillary rheometer flowtester CFT-500D (from Shimadzu Corporation).

The softening temperature of the crystalline resin is generally from 80 to 130° C., preferably from 80 to 100° C. When the softening temperature of the crystalline resin falls below 80° C., heat-resistant storage stability of the toner may deteriorate. When the softening temperature of the crystalline resin exceeds 130° C., low-temperature fixability of the toner may deteriorate.

A crystalline resin having a melting point of from 60 to 80° C. and a softening temperature of from 80 to 130° C. is generally prepared from aliphatic compounds with no aromatic compounds.

The storage elastic modulus G' of the crystalline resin at a temperature 20° C. higher than the melting point is generally from $5.0\times10^5$ Pa·s or less, preferably from $1.0\times10^1$ to $5.0\times10^5$ Pa·s, and more preferably from $1.0\times10^1$ to $1.0\times10^4$ Pa·s.

The loss elastic modulus G" of the crystalline resin at a temperature 20° C. higher than the melting point is generally from $5.0\times10^5$ Pa·s or less, preferably from $1.0\times10^1$ to $5.0\times10^5$ Pa·s, and more preferably from $1.0\times10^1$ to $1.0\times10^4$ Pa·s.

The storage elastic modulus G' and loss elastic modulus G" can be measured by a rheometer ARES (from TA Instruments) at a frequency of 1 Hz.

From the viewpoint of fixability, it is said that the crystalline resin preferably has a weight average molecular weight (Mw) of from 2,000 to 100,000, more preferably from 5,000 to 60,000, and most preferably from 8,000 to 30,000. When the weight average molecular weight is less than 2,000, hot offset resistance is likely to deteriorate. When the weight average molecular weight exceeds 100,000, low-temperature fixability is likely to deteriorate.

However, in accordance with some embodiments of the present invention, the weight average molecular weight of the crystalline resin is set to preferably from 100,000 to 200,000, more preferably from 120,000 to 160,000. When the weight average molecular weight is less than 100,000, the crystalline resin will become more compatible with the amorphous resin when the toner is being fixed at a high temperature under heat and pressure. As a result, heat-resistant storage stability of the toner may deteriorate. When the weight average molecular weight exceeds 200,000, the crystalline resin will exist in the form of big domains in the toner, causing deterioration in grindability, heat-resistant storage stability, and chargeability.

A combination use of the crystalline resin which has a large molecular weight and the amorphous resin which has a small molecular weight can suppress deterioration in low-temperature fixability of the toner.

The weight average molecular weight of the crystalline resin is a polystyrene-equivalent molecular weight determined by gel permeation chromatography.

Amorphous Resin

The amorphous resin is not limited to particular materials so long as it causes a phase separation from the crystalline resin. Specific examples of the amorphous resin include, but are not limited to, amorphous polyester, amorphous polyurethane, amorphous polyurea, amorphous polyamide, amorphous polyether, amorphous vinyl resin, amorphous urethane-modified polyester, and amorphous urea-modified polyester. Two or more of these resins can be used in combination. Among these resins, amorphous polyester is preferable.

The amorphous polyester has a constitutional unit derived from an aromatic compound.

Specific examples of the aromatic compound include, but are not limited to, alkylene oxide adducts of bisphenol A, isophthalic acid, terephthalic acid, and derivatives thereof. The content of the constitutional unit derived from an aromatic compound in the amorphous polyester is 50% by weight or more. When the content of the constitutional unit derived from an aromatic compound in the amorphous polyester is less than 50% by weight, negative chargeability of the toner may deteriorate.

The glass transition temperature of the amorphous resin is generally from 45 to 75° C., preferably from 50 to 70° C. When the glass transition temperature of the amorphous resin falls below 45° C., heat-resistant storage stability of the toner may deteriorate. When the glass transition temperature of the amorphous resin exceeds 75° C., low-temperature fixability of the toner may deteriorate.

The softening temperature of the amorphous resin is generally from 90 to 150° C., preferably from 90 to 130° C. When the softening temperature of the amorphous resin falls below 90° C., heat-resistant storage stability of the toner may deteriorate. When the softening temperature of the amorphous resin exceeds 150° C., low-temperature fixability of the toner may deteriorate.

The weight average molecular weight of the amorphous resin is generally from 1,000 to 100,000, preferably from 2,000 to 50,000, and more preferably from 3,000 to 10,000. When the weight average molecular weight of the amorphous resin falls below 1,000, heat-resistant storage stability of the toner may deteriorate. When the weight average molecular weight of the amorphous resin exceeds 100,000, low-temperature fixability of the toner may deteriorate.

The weight average molecular weight of the amorphous resin is a polystyrene-equivalent molecular weight determined by gel permeation chromatography.

The toner according to some embodiments of the present invention includes a core particle, a second shell layer overlying the core particle, and a first shell layer overlying the second shell layer and constituting an outermost layer. The core particle includes toner materials such as a binder resin, a release agent (e.g., a wax), a colorant, a charge controlling agent, a flowability improver, etc. In the present disclosure, "toner materials" is used for the same meaning as "core materials".

Release Agent

Specific examples of the release agent include, but are not limited to, solid silicone wax, higher fatty acid higher alcohol, montan ester wax, polyethylene wax, polypropylene wax, and combinations thereof. Among these waxes, free-fatty-acid-free carnauba wax, polyethylene wax, montan wax, oxidized rice wax are preferable because they can be finely dispersed in the toner. These waxes can be used in combination.

Preferably, the carnauba wax is a microcrystal and has an acid value of 5 mgKOH/g or less.

The montan wax is obtainable by purifying a mineral. Preferably, the montan wax is a microcrystal and has an acid value of from 5 to 14 mgKOH/g.

The oxidized rice wax is obtainable by oxidizing a rice bran wax with air. Preferably, the oxidized rice wax has an acid value of from 10 to 30 mgKOH/g.

The glass transition temperature of the release agent is generally from 70 to 90° C. When the glass transition temperature of the release agent falls below 70° C., heat-resistant storage stability of the toner may deteriorate. When the glass transition temperature of the release agent exceeds 90° C., cold offset resistance of the toner may deteriorate or paper winding may be caused around a fixer.

The weight ratio of the release agent to the binder resin is generally from 0.01 to 0.20, preferably from 0.03 to 0.10. When the weight ratio of the release agent to the binder resin falls below 0.01, hot offset resistance of the toner may deteriorate. When the weight ratio of the release agent to the binder resin exceeds 0.20, transferability and durability of the toner may deteriorate.

Colorant

Specific examples of the colorant include, but are not limited to, yellow pigments such as Cadmium Yellow, Mineral Fast Yellow, Nickel Titanium Yellow, Naples Yellow, Naphthol Yellow S, Hansa yellow G, Hansa yellow 10G, Benzidine Yellow GR, Quinoline Yellow Lake, Permanent Yellow NCG, and Tartrazine Lake; orange pigments such as Molybdenum Orange, Permanent Orange GTR, Pyrazolone Orange, Vulcan Orange, Indanthrene Brilliant Orange RK, Benzidine Orange G, and Indanthrene Brilliant Orange GK; red pigments such as Red Iron Oxide, Cadmium Red, Permanent Red 4R, Lithol Red, Pyrazolone Red, Watching Red calcium salt, Lake Red D, Brilliant Carmine 6B, Eosin Lake, Rhodamine Lake B, Alizarin Lake, and Brilliant Carmine 3B; violet pigments such as Fast Violet B and Methyl Violet Lake; blue pigments such as Cobalt Blue, Alkali Blue, Victoria Blue lake, Phthalocyanine Blue, Metal-free Phthalocyanine Blue, partial chlorination product of Phthalocyanine Blue, Fast Sky Blue, and Indanthrene Blue BC; green pigments such as Chrome Green, chrome oxide, Pigment Green B, and Malachite Green Lake; and black pigments such as azine dyes (e.g., carbon black, oil furnace black, channel black, lamp black, acetylene black, aniline black), metal salt azo dyes, metal oxides, and combined metal oxides. Two or more of these colorants can be used in combination.

Charge Controlling Agent

Specific examples of the charge controlling agent include, but are not limited to, nigrosine, azine dyes having an alkyl group having 2 to 16 carbon atoms (described in JP-S42-1627-B); basic dyes (e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000)) and lake pigments thereof; quaternary ammonium salts (e.g., C.I. Solvent Black 8 (C.I. 26150), benzoylmethylhexadecyl ammonium chloride, decyltrimethyl chloride); dialkyl tin compounds (e.g., dibutyltin, dioctyltin); dialkyl tin borate compounds; guanidine derivatives; polyamine resins (e.g., vinyl polymers having amino group, condensed polymers having amino group); metal complex salts of monoazo dyes described in JP-S41-20153-B, JP-S43-27596-B, JP-S44-6397-B, and JP-45-26478-B; metal complexes of salicylic acid, dialkyl salicylic acid, naphthoic acid, and dicarboxylic acid with Zn, Al, Co, Cr, or Fe, described in JP-S55-42752-B and JP-S59-7385-B; sulfonated copper phthalocyanine pigments; organic boron salts; fluorine-containing quaternary ammonium salts; and calixarene compounds. Two or more of these compounds can be used in combination.

Flowability Improver

Specific examples of the flowability improver include, but are not limited to, silica, alumina, titanium oxide, barium titanate, magnesium titanate, calcium titanate, strontium titanate, zinc oxide, quartz sand, montmorillonite, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Two or more of these materials can be used in combination. Among these materials, silica, alumina, and titanium oxide are preferable.

Preferably, the flowability improver includes silicon atoms, which form a silicone compound such as silica, and an optional metal atom (doped compound).

Specific examples of the metal atom include, but are not limited to, Mg, Ca, Ba, Al, Ti, V, Sr, Zr, Zn, Ga, Ge, Cr, Mn, Fe, Co, Ni, and Cu.

The flowability improver may be surface-treated with a hydrophobizing agent.

Specific examples of the hydrophobizing agent include, but are not limited to, silane coupling agents, silylation agents, silane coupling agents having a fluorinated alkyl group, organic titanate coupling agents, aluminum coupling agents, and silicone oils.

The content of the flowability improver in the toner is generally from 0.1 to 5% by weight.

The flowability improver preferably has an average primary particle diameter of from 5 to 1,000 nm, more preferably from 5 to 500 nm.

The average primary particle diameter of the flowability improver is the average of the long diameters among at least 100 or more particles observed by transmission electron microscope.

The weight average particle diameter (D4) of the toner is generally from 3 to 8 μm, preferably from 4 to 7 μm.

The ratio of the number average particle diameter (D1) to the weight average particle diameter (D4) of the toner is generally from 1.00 to 1.40, preferably from 1.05 to 1.30.

The number average particle diameter (D1) and weight average particle diameter (D4) of the toner can be measured by a Coulter counter method.

The toner according to some embodiments of the present invention (i.e., a toner including a core particle, a second shell layer including a crystalline resin, and a first shell layer including an amorphous resin, where the second shell layer overlying the core particle, and the first shell layer overlying the second shell layer and constituting the outermost layer) can be produced by, for example, an emulsion aggregation method, a suspension polymerization method, or a dissolution suspension method. In particular, the toner is produced through the processes of forming the core particle by a known method, forming the second shell layer including a crystalline resin, and forming the first shell layer including an amorphous resin.

Methods of manufacturing the toner employing a dissolution suspension method and an emulsion aggregation method are described below for illustration.

Dissolution Suspension Method

A method of manufacturing the toner according to some embodiments of the present invention which employs a dissolution suspension method includes the following processes (I) to (VI). The method may include other processes in between any two of the processes (I) to (VI) of after the processes (I) to (VI).

(I) A process of dissolving or dispersing core materials including at least a binder resin in a solvent, thereby preparing a solution or dispersion liquid of the core materials.

(II) A process of subjecting the crystalline resin in a melted state to an emulsification treatment along with a treatment liquid to obtain a crystalline resin particle and diluting the crystalline resin particle with a solvent including water, thereby preparing an aqueous phase (a).

(III) A process of mixing the solution or dispersion liquid of the core materials in the aqueous phase (a), thereby preparing an emulsion slurry (1).

(IV) A process of subjecting the amorphous resin in a melted state to an emulsification treatment along with a treatment liquid to obtain an amorphous resin particle and diluting the amorphous resin particle with a solvent including water, thereby preparing an aqueous phase (b).

(V) A process of mixing the emulsion slurry (1) in the aqueous phase (b) and subjecting the mixture to a solvent removal treatment under reduced pressures, thereby preparing a solvent-free slurry (2).

(VI) A process of heating the solvent-free slurry (2) to fix the crystalline resin particle and the amorphous resin particle on the core particle.

In the process (I), toner materials such as a binder resin (preferably an amorphous polyester), a release agent, and a colorant are dissolved or dispersed in a solvent (e.g., ethyl acetate) to prepare a solution or dispersion liquid of core materials. The colorant can be used in the form of a master batch.

In the process (II), first, a crystalline resin (e.g., a crystalline polyester) is put into a melted state. The melted crystalline resin and a treatment liquid (e.g., diluted ammonia water) are subjected to an emulsification treatment using a high-pressure homogenizer (e.g., Manton Gaulin High-pressure Homogenizer from Gaulin) to obtain particles of the crystalline resin (hereinafter "crystalline resin particle").

The crystalline resin particle is diluted with a solvent (e.g., ethyl acetate including a surfactant such as dodecyl diphenyl ether sodium disulfonate) including water to prepare an aqueous phase (a).

In the process (III), the solution or dispersion liquid of core materials is mixed in the aqueous phase (a) to prepare an emulsion slurry (1).

In the process (IV), first, an amorphous resin (e.g., an amorphous polyester) is put into a melted state. The melted amorphous resin and a treatment liquid (e.g., diluted ammonia water) are subjected to an emulsification treatment using a high-pressure homogenizer (e.g., Manton Gaulin High-pressure Homogenizer from Gaulin) to obtain particles of the amorphous resin (hereinafter "amorphous resin particle").

The amorphous resin particle is diluted with a solvent (e.g., ethyl acetate including a surfactant such as dodecyl diphenyl ether sodium disulfonate) including water to prepare an aqueous phase (b).

In the process (V), the emulsion slurry (1) is mixed in the aqueous phase (b) and the mixture is subjected to a solvent removal treatment under reduced pressures (for example, at 30° C. for 12 hours) to prepare a solvent-free slurry (2).

In the process (VI), the solvent-free slurry (2) is heated (for example, at 60° C.) so that the crystalline resin particle and the amorphous resin particle are fixed on the surface of the core particle.

In addition, a washing process and a drying process follow the above processes.

Specifically, the solvent-free slurry (2) is let through a sieve (e.g., a nylon mesh having an opening of 15 μm) to remove coarse particles and then filtered. Particles deposited on a filter paper are pulverized into fine particles and the fine particles are washed with ion-exchange water. The fine particles are repeatedly washed until the conductivity of the filtrate becomes 10 μS/cm or less. The fine particles are then vacuum-dried in an oven, thereby preparing a mother toner particle.

A method of manufacturing the toner according to some embodiments of the present invention which employs an emulsion aggregation method includes the following processes (I) to (VIII). The method may include other processes in between any two of the processes (I) to (VIII) of after the processes (I) to (VIII).

(I) A process of subjecting the amorphous resin in a melted state to an emulsification treatment along with a treatment liquid to obtain an amorphous resin particle and diluting the amorphous resin particle with a solvent including water, thereby preparing an amorphous resin particle dispersion liquid (A).

(II) A process of subjecting the crystalline resin in a melted state to an emulsification treatment along with a treatment liquid to obtain a crystalline resin particle and diluting the crystalline resin particle with a solvent including water, thereby preparing a crystalline resin particle dispersion liquid (B).

(III) A process of dispersing a wax in a water with a surfactant, thereby preparing a wax dispersion liquid.

(IV) A process of heat-mixing the amorphous resin particle dispersion liquid (A) and the wax dispersion liquid, thereby preparing a core particle dispersion liquid containing the core particle having a desired particle diameter.

(V) A process of mixing the crystalline resin particle dispersion liquid (B) in the core particle dispersion liquid.

(VI) A process of mixing the amorphous resin particle dispersion liquid (A) in the mixture obtained in the process (V).

(VII) A process of subjecting the mixture obtained in the process (VI) to a solvent removal treatment under reduced pressures, thereby preparing a solvent-free slurry (2).

(VIII) A process of heating the solvent-free slurry (2) to fix the crystalline resin particle and the amorphous resin particle on the core particle.

In the process (I), first, an amorphous resin (e.g., an amorphous polyester) is put into a melted state. The melted amorphous resin and a treatment liquid (e.g., diluted ammonia water) are subjected to an emulsification treatment using a high-pressure homogenizer (e.g., Manton Gaulin High-pressure Homogenizer from Gaulin) to obtain particles of the amorphous resin (hereinafter "amorphous resin particle").

The amorphous resin particle is diluted with a solvent (e.g., ethyl acetate including a surfactant such as dodecyl diphenyl ether sodium disulfonate) including water to prepare an amorphous resin particle dispersion liquid (A).

In the process (II), first, a crystalline resin (e.g., a crystalline polyester) is put into a melted state. The melted crystalline resin and a treatment liquid (e.g., diluted ammonia water) are subjected to an emulsification treatment using a high-pressure homogenizer (e.g., Manton Gaulin High-pressure Homogenizer from Gaulin) to obtain particles of the crystalline resin (hereinafter "crystalline resin particle").

The crystalline resin particle is diluted with a solvent (e.g., ethyl acetate including a surfactant such as dodecyl diphenyl ether sodium disulfonate) including water to prepare a crystalline resin particle dispersion liquid (B).

In the process (III), a release agent (e.g., a wax) is dispersed in water (e.g., ion-exchange water) with a surfactant (e.g., an anionic surfactant) to prepare a wax dispersion liquid.

In the process (IV), the amorphous resin particle dispersion liquid, the wax dispersion liquid, a surfactant (e.g., an anionic surfactant), water (e.g., ion-exchange water), and an aqueous solution of aluminum sulfate are heat-mixed to prepare a core particle dispersion liquid containing the core particle having a desired particle diameter (for example, a volume average particle diameter of 5.6 μm).

In the process (V), the crystalline resin particle dispersion liquid (B) is mixed in the core particle dispersion liquid to form the second shell layer.

In the process (VI), the amorphous resin particle dispersion liquid (A) is further mixed in the mixture obtained in the process (V) (for example, 30 minutes later from the process (V)).

In the process (VII), the mixture obtained in the process (VI) is subjected to a solvent removal treatment under reduced pressures to prepare a solvent-free slurry (2).

In the process (VIII), the solvent-free slurry (2) is heated so that the crystalline resin particle and the amorphous resin particle are fixed on the surface of the core particle.

In addition, a washing process and a drying process follow the above processes.

Specifically, the solvent-free slurry (2) is let through a sieve (e.g., a nylon mesh having an opening of 15 μm) to remove coarse particles and then filtered. Particles deposited on a filter paper are pulverized into fine particles and the fine particles are washed with ion-exchange water. The fine particles are repeatedly washed until the conductivity of the filtrate becomes 10 μS/cm or less. The fine particles are then vacuum-dried in an oven, thereby preparing a mother toner particle.

The mother toner particle as it is can be used for a toner, however, it is preferable that external additives such as hydrophobic silica and hydrophobized titanium oxide are added thereto. For example, a toner can be prepared by mixing the mother toner particle (for example, in an amount of 100 parts by weight) with a hydrophobic silica (for example, in an amount of 1 part by weight) and a hydrophobized titanium oxide (for example, in an amount of 0.7 parts by weight) by a mixer (e.g., HENSCHEL MIXER).

In accordance with some embodiments of the present invention, the toner can be used for either one-component developer consisting primarily of toner or two-component developer consisting primarily of toner and carrier. In addition, the toner can be used as either magnetic toner or non-magnetic toner. A magnetic toner can be obtained by including a magnetic material to the toner composition.

Image Forming Apparatus and Image Forming Method

An image forming apparatus according to some embodiments of the present invention includes: a latent image bearer; a charger to charge a surface of the latent image bearer; an irradiator to irradiate the charged surface of the latent image bearer with light to form an electrostatic latent image thereon; a developing device to develop the electrostatic latent image into a toner image with the toner according to some embodiment of the present invention; a transfer device to transfer the toner image from the surface of the latent image bearer onto a recording medium; and a fixing device to fix the toner image on the recording medium.

The image forming apparatus may optionally include other devices such as a neutralizer, a cleaner, a recycler, and a controller, if needed. The charger is adapted to uniformly charge a surface of the latent image bearer. The irradiator is adapted to irradiate the charged surface of the latent image bearer with light based on image information to form an electrostatic latent image thereon.

An image forming method according to some embodiments of the present invention includes the processes of: charging a surface of a latent image bearer; irradiating the charged surface of the latent image bearer with light to form an electrostatic latent image thereon; developing the electrostatic latent image into a toner image with the toner according to some embodiment of the present invention; transferring the toner image from the surface of the latent image bearer onto a recording medium; and fixing the toner image on the recording medium.

The image forming method may optionally include other processes such as a neutralization process, a cleaning process, a recycle process, and a control process, if needed. The charging process is for uniformly charging a surface of the latent image bearer. The irradiating process is for irradiating the charged surface of the latent image bearer with light based on image information to form an electrostatic latent image thereon.

An electrostatic latent image is formed as the charger charges a surface of the latent image bearer, and then the irradiator irradiates the charged surface of the latent image bearer with light based on image information. The electrostatic latent image formed on the latent image bearer (e.g., a photoconductor drum) is developed into a toner image (visible image) by forming a toner layer on a developing roller, serving as a developer bearer, and bringing it into contact with the latent image bearer.

The toner is stirred by a stirrer and mechanically supplied to a developer supply member. The toner is further supplied from the developer supply member to the developer bearer and accumulated thereon. By passing through a developer layer regulator provided in contact with the developer bearer, the toner is formed into a uniform thin layer while being charged. The electrostatic latent image formed on the latent image bearer is developed into a toner image as the toner charged in the developing device is adhered thereto within a developing region. The toner image (visible image) is transferred as the transfer device charges the latent image bearer (photoconductor drum). The toner image (visible image) transferred onto a recording medium is fixed thereon by the fixing device. Each single-color toner image may be independently fixed on a recording medium, or alternatively, a composite toner image including a plurality of color toner images may be fixed on a recording medium at once. The fixing device is not limited in configuration but preferably includes a heat-pressure member. Specific examples of the heat-pressure member include, but are not limited to, a combination of a heat roller and a pressure roller, and a combination of a heat roller, a pressure roller, and an endless belt. The heating temperature of the heat-pressure member is preferably from 80 to 200° C.

Figure 2:
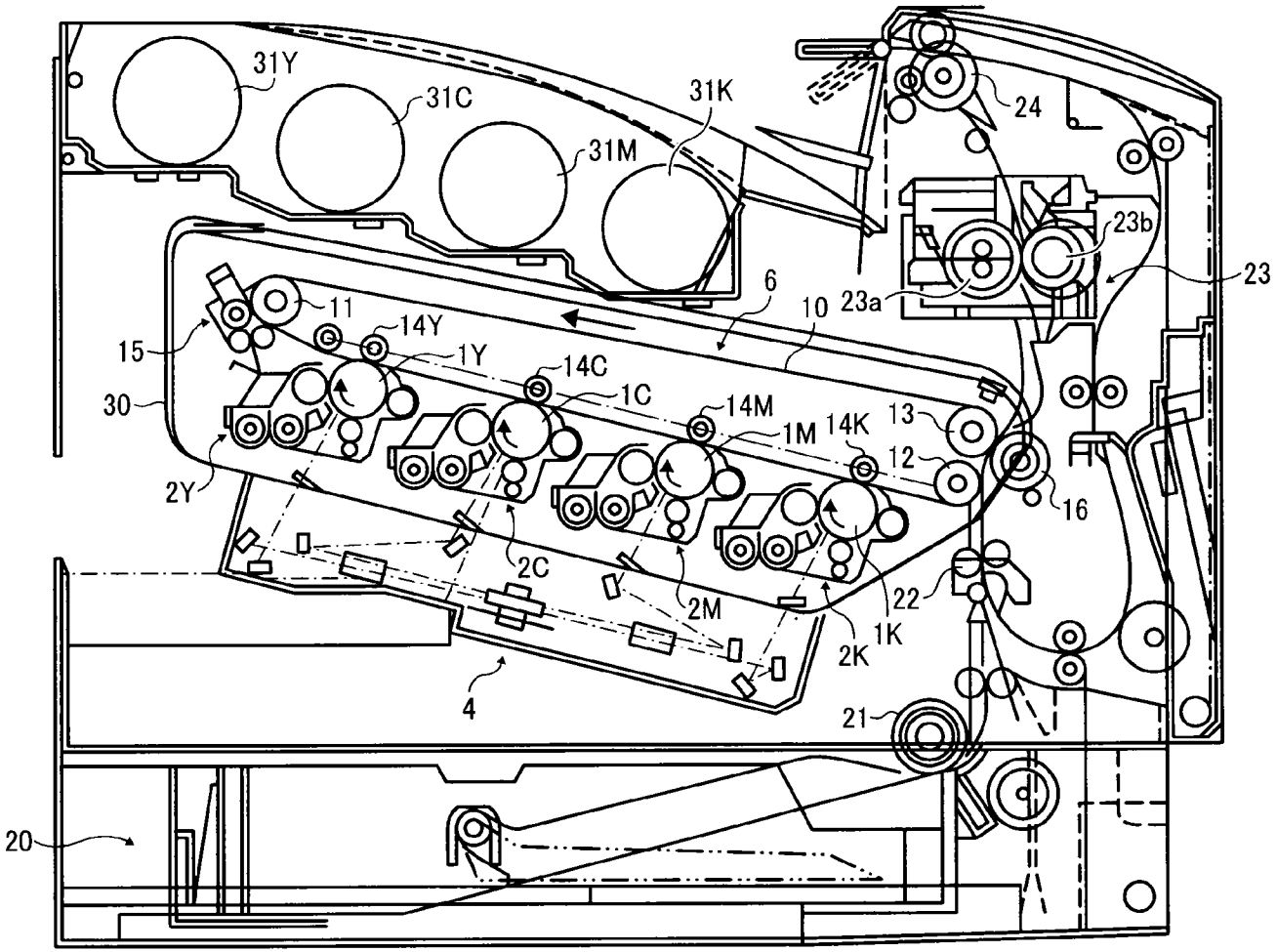
FIG. 2 is a schematic view of an image forming apparatus according to some embodiments of the present invention.

FIG. 2 is a schematic view of an image forming apparatus according to some embodiments of the present invention. This image forming apparatus is an electrophotographic image forming apparatus. This image forming apparatus forms color image with four toners: yellow (Y) toner, cyan (C) toner, magenta (M) toner, and black (K) toner.

The image forming apparatus includes four photoconductors 1Y, 1C, 1M, and 1K, each serving as a latent image bearer. In FIG. 2, each of the photoconductors 1Y, 1C, 1M, and 1K is in a drum-like shape. Alternatively, each the photoconductors 1Y, 1C, 1M, and 1K may be in a belt-like shape. Each of the photoconductors 1Y, 1C, 1M, and 1K is driven to rotate in a direction indicated by arrow in FIG. 2 while containing an intermediate transfer belt 10 serving as a surface moving member. Each of the photoconductors 1Y, 1C, 1M, and 1K is formed of a thin-wall cylindrical conductive substrate, a photosensitive layer formed on the substrate, and a protective layer formed the photosensitive layer. An intermediate layer may be optionally formed between the photosensitive layer and the protective layer.

Figure 3:
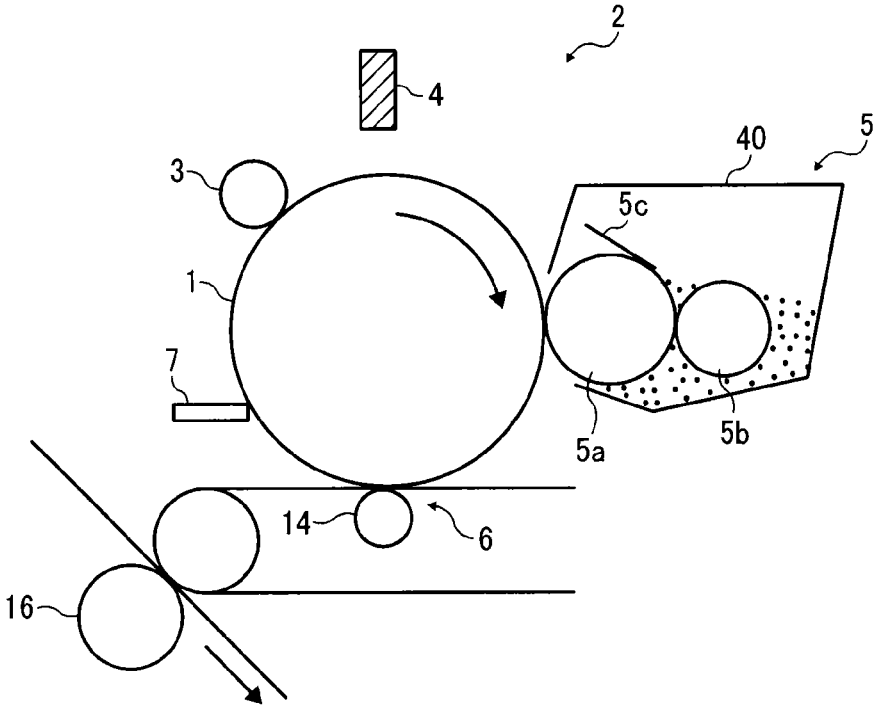
FIG. 3 is a schematic view of the image forming part in the image forming apparatus illustrated in FIG. 2.

FIG. 3 is a schematic view of an image forming part 2 in the image forming apparatus illustrated in FIG. 2. Referring to FIG. 2, image forming parts 2Y, 2C, 2M, and 2K containing the respective photoconductors 1Y, 1C, 1M, and 1K have the same configuration. Therefore, in FIG. 3, a single unit of the image forming part 2 is illustrated omitting the additional characters Y, C, M, and K representing colors of yellow, cyan, magenta, and black, respectively. Around the photoconductor 1, a charger 3, a developing device 5, a transfer device 6, and a cleaner 7 are arranged along the direction of surface movement of the photoconductor 1. The transfer device 6 transfers a toner image from the photoconductor 1 onto a recording medium or the intermediate transfer belt 10. The cleaner 7 removes untransferred toner particles remaining on the photoconductor 1.

A sufficient space is provided between the charger 3 and the developing device 5 so that light emitted from an irradiator 4 can reach the charged surface of the photoconductor 1 and an electrostatic latent image is formed thereon based on image information. The charger 3 negatively charges a surface of the photoconductor 1. The charger 3 is equipped with a charging roller employing a contact or proximity charging method. The charger 3 charges a surface of the photoconductor 1 by bringing the charging roller into contact with or close to the surface of the photoconductor 1 while applying a negative bias to the charging roller.

The charging roller is applied with a direct-current charging bias for charging the photoconductor 1 to have a surface potential of −500 V. The charging bias may be a superimposed bias in which an alternating-current bias is superimposed on a direct-current bias. The charger 3 may have a cleaning brush for cleaning the surface of the charging roller. Alternatively, the charger 3 may have a configuration such that the charging roller is in contact with the photoconductor 1 with a thin film wound around the peripheral surface of the charging roller at both axial end parts. In this configuration, the surface of the charging roller is very close to the surface of the photoconductor 1 forming a small gap therebetween. The gap distance is equivalent to the thickness of the film. By applying the charging bias to the charging roller, electric discharge occurs between the surface of the charging roller and the surface of the photoconductor 1, thereby charging the surface of the photoconductor 1.

The surface of the photoconductor 1 thus charged is irradiated with light emitted from the irradiator 4, thereby forming an electrostatic latent image corresponding to each color. The irradiator 4 is adapted to write an electrostatic latent image on the photoconductor 1 based on image information corresponding to each color. In the present embodiment, the irradiator 4 employs a laser method. Alternatively, the irradiator 4 may employ another method using an LED array and imaging means.

Toner is supplied from each toner bottle 31Y, 31C, 31M, or 31K to the developing device 5 and conveyed by a developer supply roller 5*b* to be borne on a developing roller 5*a*. The developing roller 5*a* conveys the toner to a region (hereinafter "developing region") where the developing roller 5*a* is facing the photoconductor 1. In the developing region, the surface of the developing roller 5*a* moves in the same direction as the surface of the photoconductor 1 moves at a speed higher than that of the photoconductor 1. The toner is supplied to the surface of the photoconductor 1 as the toner borne on the developing roller 5*a* is slidably contacting the surface of the photoconductor 1. A −300-V developing bias is applied to the developing roller 5*a* from a power source, thereby forming a developing electric field in the developing region. An electric attractive force acts on the toner on the developing roller 5*a* toward the electrostatic latent image on the photoconductor 1. As a result, the toner on the developing roller 5*a* is adhered to the electrostatic latent image on the photoconductor 1. The electrostatic latent image on the photoconductor 1 is thereby developed into a toner image.

In the transfer device 6, the intermediate transfer belt 10 is stretched taut across three support rollers 11, 12, and 13. The intermediate transfer belt 10 endlessly moves in a direction indicated by arrow in FIG. 2. Toner images are electrostatically transferred from the photoconductors 1Y, 1C, 1M, and 1K onto the intermediate transfer belt 10 while overlapping one another. To electrostatically transfer toner images, a transfer charger can be employed. However, in the present embodiment, a primary transfer roller 14, which produces transfer dust less frequently, is employed.

More specifically, primary transfer rollers 14Y, 14C, 14M, and 14K are disposed facing the back surface of the intermediate transfer belt 10 at positions where the respective photoconductors 1Y, 1C, 1M, and 1K are in contact with the intermediate transfer belt 10. Primary transfer nip portions are formed between the intermediate transfer belt 10 and the photoconductors 1Y, 1C, 1M, and 1K at positions where the respective primary transfer rollers 14Y, 14C, 14M, and 14K are pressed against the intermediate transfer belt 10. When the toner images are transferred from the photoconductors 1Y, 1C, 1M, and 1K onto the intermediate transfer belt 10, a positive bias is applied to each primary transfer roller 14. A transfer electric field is thereby formed in each primary transfer nip portion, and the toner images on the photoconductors 1Y, 1C, 1M, and 1K are electrostatically adhered to the intermediate transfer belt 10.

A belt cleaner 15 for removing residual toner particles from the intermediate transfer belt 10 is disposed facing the intermediate transfer belt 10. The belt cleaner 15 has a configuration such that a fur brush or cleaning blade collects undesired toner particles adhered to the surface of the intermediate transfer belt 10. The collected undesired toner particles are conveyed by a conveyer from the belt cleaner 15 to a waste toner tank. A secondary transfer roller 16 is disposed in contact with the intermediate transfer belt 10 at a position where the support roller 13 supports the intermediate transfer belt 10.

A secondary transfer nip portion is formed between the intermediate transfer belt 10 and the secondary transfer roller 16. A sheet of transfer paper, serving as a recording medium, is fed to the secondary transfer nip portion at a predetermined timing. Sheets of transfer paper are stored in the paper feeding cassette 20 disposed below the irradiator 4. Each sheet is fed to the secondary transfer nip portion by a paper feeding roller 21, a pair of registration rollers 22, etc. The composite toner image formed on the intermediate transfer belt 10 is transferred onto a sheet of transfer paper at the secondary transfer nip portion. At this time, a positive polarity is applied to the secondary transfer roller 16, thereby forming a transfer electric field. The composite toner image is transferred from the intermediate transfer belt 10 onto the sheet by the action of the transfer electric field. On a downstream side from the secondary transfer nip portion with respect to the direction of conveyance of transfer paper, a heat fixing device 23 is disposed. The heat fixing device 23 includes a heat roller 23*a* having a built-in heater and a pressure roller 23*b* for applying pressure. The sheet of transfer paper having passed through the secondary transfer nip portion is sandwiched between these rollers and received heat and pressure. The toner on the sheet is melted, thereby fixing the composite toner image on the sheet. The sheet having the fixed composite toner image thereon is ejected on a paper ejection tray disposed on an upper surface of the image forming apparatus by a paper ejection roller 24.

In the developing device 5, the developing roller 5*a*, serving as a developer bearer, is partially exposed at an opening of its casing. Here, the developing device 5 uses a one-component developer that includes no carrier. The developing device 5 stores toner having a corresponding color supplied from the toner bottle 31Y, 31C, 31M, or 31K. The toner bottles 31Y, 31C, 31M, and 31K are detachably mounted independently on the image forming apparatus so that each of them is independently replaceable.

When the toner is finished, it is only necessary to replace the toner bottle 31Y, 31C, 31M, or 31K. Accordingly, structure members which have not reached the end of their life-span when the toner is finished can be continuously used, reducing users' expense.

Figure 4:
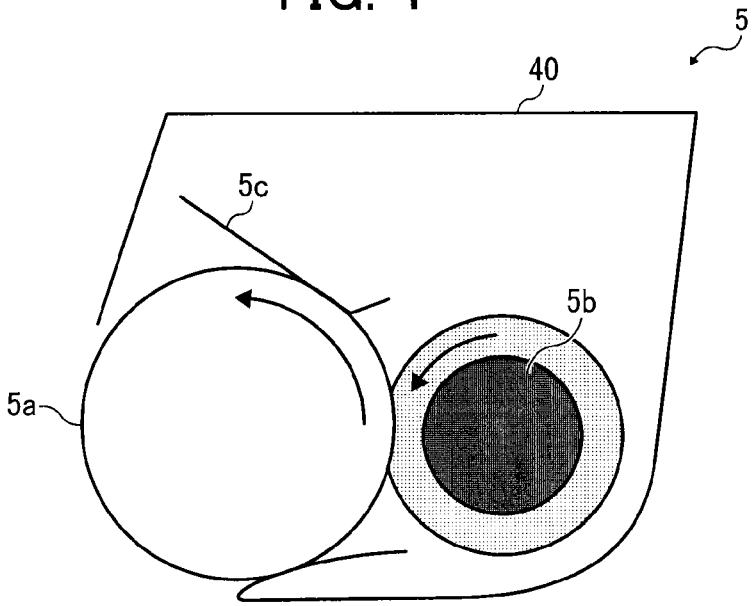
FIG. 4 is a schematic view of the developing device in the image forming part illustrated in FIG. 3.

FIG. 4 is a schematic view of the developing device 5 in the image forming part illustrated in FIG. 3. The developer (toner) stored in a developer storage 40 is conveyed to a nip portion between the photoconductor 1 and the developing roller 5*a*, serving as a developer bearer, by being stirred by the developer supply roller 5*b*, serving as a developer supply member. The developer supply roller 5*b* and the developing roller 5*a* rotate in the opposite direction from each other in the nip portion. A regulation blade 5C, serving as a developer layer regulator, is disposed in contact with the developing roller 5*a*. The regulation blade 5C regulates the amount of toner on the developing roller 5*a* and forms a thin toner layer on the developing roller 5*a*. The toner is frictionally charged at the nip portion between the developer supply roller 5*b* and the developing roller 5*a* and the contact portion of the regulation blade 5C with the developing roller 5*a* to have a proper charge quantity.

A process cartridge according to some embodiments of the present invention includes a latent image bearer to bear an electrostatic latent image and a developing device to develop the electrostatic latent image into a toner image with the toner according to some embodiments of the present invention. The process cartridge is detachably mountable on image forming apparatus.

Figure 5:
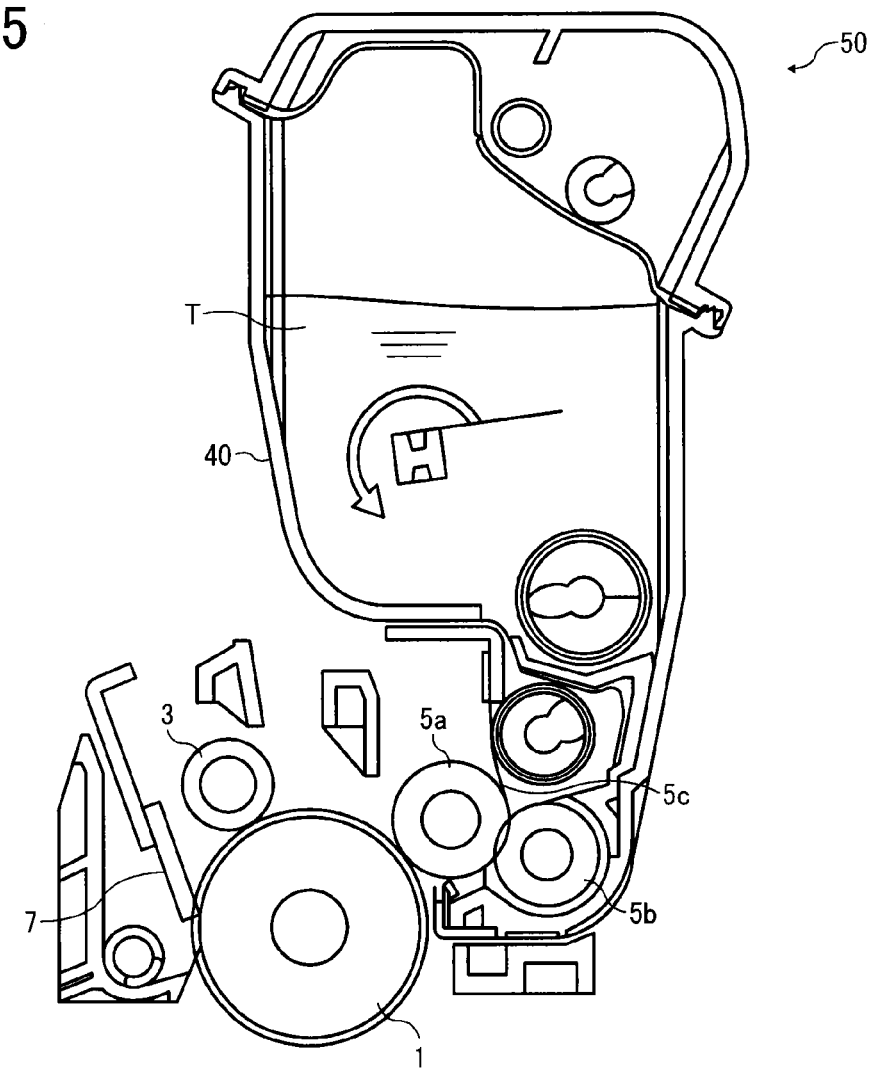
FIG. 5 is a schematic view of a process cartridge according to some embodiments of the present invention.

FIG. 5 is a schematic view of a process cartridge according to some embodiments of the present invention. The toner according to some embodiments of the present invention can be used for an image forming apparatus including a process cartridge 50 illustrated in FIG. 5. Among structure members for image forming apparatus such as a latent image bearer, a charger, a developing device, etc., the process cartridge 50 integrally supports a latent image bearer to bear an electrostatic latent image and a developing device to develop the electrostatic latent image into a toner image with the toner according to some embodiments of the present invention. The process cartridge 50 is detachably mountable on an image forming apparatus such as copier and printer. The process cartridge 50 includes a latent image bearer, a charger, and the developing device 5 illustrated in FIG. 4. In FIG. 5, an alphabet T denotes a toner.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

In Examples, melting point Ta, softening temperature Tb, glass transition temperature, and weight average molecular weight are measured as follows.

Melting Point Ta

Melting point Ta is measured by differential scanning calorimeters (DSC) TA-60WS and DSC-60 (from Shimadzu Corporation). First, a sample is melted at 130° C., cooled to 70° C. at a cooling rate of 1.0° C./min, and further cooled to 10° C. at a cooling rate of 0.5° C./min. The sample is then heated at a heating rate of 20° C./min. A temperature at which an endothermic peak is observed within a range of from 20 to 100° C. is identified as Ta*. In a case in which plural endothermic peaks are observed, a temperature at which an endothermic peak having the maximum endothermic quantity is observed is identified as Ta*. The sample is stored at (Ta*−10)° C. for 6 hours and then at (Ta*−15)° C. for 6 hours. Next, the sample is cooled to 0° C. at a cooling rate of 10° C./min and heated at a heating rate of 20° C./min. A temperature at which an endothermic peak is observed is identified as the melting point Ta. In a case in which plural endothermic peaks are observed, a temperature at which an endothermic peak having the maximum endothermic quantity is observed is identified as the melting point Ta.

Softening Temperature Tb

Softening temperature Tb is measured by a capillary rheometer flowtester CFT-500D (from Shimadzu Corporation). A sample in an amount of 1 g is extruded from a nozzle having a diameter of 1 mm and a length of 1 mm while a plunger applies a load of 1.96 MPa to the sample and the sample is heated at a heating rate of 6° C./min. The amount of descent of the plunger is plotted against the temperature on a chart. A temperature at which the half of the sample has flowed out is identified as the softening temperature Tb.

Glass Transition Temperature

Glass transition temperature is measured using a thermal analysis work station TA-60WS and a differential scanning calorimeter DSC-60 (from Shimadzu Corporation) under the following conditions.

Sample container: Aluminum sample pan (with a lid)

Sample quantity: 5 mg

Reference: Aluminum sample pan (containing 10 mg of alumina)

Atmosphere: Nitrogen (Flow rate: 50 ml/min)

Start temperature: 20° C.

Temperature rising rate: 10° C./min

End temperature: 150° C.

Retention time: None

Temperature descending rate: 10° C./min

End temperature: 20° C.

Retention time: None

Temperature rising rate: 10° C./min

End temperature: 150° C.

Measurement result is subjected to an analysis by a data analysis software program TA-60 version 1.52 (from Shimadzu Corporation). First, a DrDSC curve that is a differential curve of a DSC curve obtained in the second heating is analyzed using a peak analysis function of the data analysis software program to determine a peak temperature within a temperature range of from −5° C. to +5° C. of a temperature at which the maximum peak is observed. Next, the DSC curve is analyzed using the peak analysis function of the data analysis software program to determine a maximum endothermic temperature within a temperature range of from −5° C. to +5° C. of the peak temperature. The maximum endothermic temperature is identified as the glass transition temperature.

Weight Average Molecular Weight

Weight average molecular weight is measured by a gel permeation chromatographic device HLC-8220GPC (from Tosoh Corporation) equipped with three-tandem columns TSKgel Super HXM-H (from Tosoh Corporation) having a length of 15 cm. A sample is dissolved in tetrahydrofuran (from Wako Pure Chemical Industries, Ltd.) containing a stabilizer to prepare a 0.15% solution thereof. The solution is filtered with a filter having a pore diameter of 0.2 μm, and 100 μl of the filtrate is injected into the GPC device. A measurement is performed under an environment of 40° C. at a flow rate of 0.45 ml/min. The molecular weight of the sample is calculated referring to a calibration curve compiled from several kinds of monodisperse polystyrene standard samples that shows the relation between the logarithmic value and the number of counts. The monodisperse polystyrene standard samples include Showdex STANDARD Std. No. S-7300, S-210, S-390, S-875, S-1980, S-10.9, S-629, S-3.0, and S-0.580 (available from Showa Denko K.K.). As the detector, an RI (refractive index) detector is used.

Synthesis Example 1

Synthesis of Amorphous Polyester 1

A reaction vessel equipped with a condenser, a stirrer, and a nitrogen inlet pipe is charged with 215 parts of propylene oxide 2 mol adduct of bisphenol A, 132 parts of ethylene oxide 2 mol adduct of bisphenol A, 126 parts of terephthalic acid, and 1.8 parts of tetrabutoxy titanate as a condensation catalyst. The mixture is subjected to a reaction at 230° C. for 6 hours under nitrogen gas flow while removing the by-product water. The mixture is further subjected to a reaction under reduced pressures of from 5 to 20 mmHg for 1 hour and then cooled to 180° C. After adding 8 parts of trimellitic anhydride, the mixture is further subjected to a reaction under reduced pressures of from 5 to 20 mmHg until the weight average molecular weight of the reaction product reaches 10,000. Thus, an amorphous polyester 1 having a glass transition temperature of 60° C. and a softening temperature of 106° C. is prepared.

Synthesis Example 2

Synthesis of Amorphous Polyester 2

A reaction vessel equipped with a condenser, a stirrer, and a nitrogen inlet pipe is charged with 215 parts of propylene oxide 2 mol adduct of bisphenol A, 132 parts of ethylene oxide 2 mol adduct of bisphenol A, 126 parts of terephthalic acid, and 1.8 parts of tetrabutoxy titanate as a condensation catalyst. The mixture is subjected to a reaction at 230° C. for 6 hours under nitrogen gas flow while removing the by-product water. The mixture is further subjected to a reaction under reduced pressures of from 5 to 20 mmHg for 1 hour and then cooled to 180° C. After adding 10 parts of trimellitic anhydride, the mixture is further subjected to a reaction under reduced pressures of from 5 to 20 mmHg until the weight average molecular weight of the reaction product reaches 15,000. Thus, an amorphous polyester 1 having a glass transition temperature of 64° C. and a softening temperature of 110° C. is prepared.

Synthesis Example 3

Synthesis of Crystalline Polyester 1

A reaction vessel equipped with a condenser, a stirrer, and a nitrogen inlet pipe is charged with 283 parts of sebacic acid, 215 parts of 1,6-hexanediol, and 1 part of titanium dihydroxybis(triethanolaminate) as a condensation catalyst. The mixture is subjected to a reaction at 180° C. for 8 hours under nitrogen gas flow while removing the by-product water. The mixture is then gradually heated to 220° C. and subjected to a reaction for 4 hours under nitrogen gas flow while removing the by-product water and 1,6-hexanediol. The mixture is further subjected to a reaction under reduced pressures of from 5 to 20 mmHg until the weight average molecular weight of the reaction product reaches 6,000. Thus, a polyester diol is prepared.

A reaction vessel equipped with a condenser, a stirrer, and a nitrogen inlet pipe is charged with 249 parts of the polyester diol, 250 parts of ethyl acetate, and 11 parts of hexamethylene diisocyanate (HDI). The mixture is subjected to a reaction at 80° C. for 5 hours under nitrogen gas flow. The ethyl acetate is removed under reduced pressures. Thus, a crystalline polyester 1 having a weight average molecular weight of 140,000, a melting point of 66° C., and a softening temperature of 84° C. is prepared.

Synthesis Example 4

Synthesis of Crystalline Polyester 2

A reaction vessel equipped with a condenser, a stirrer, and a nitrogen inlet pipe is charged with 322 parts of dodecanedioic acid, 215 parts of 1,6-hexanediol, and 1 part of titanium dihydroxybis(triethanolaminate) as a condensation catalyst. The mixture is subjected to a reaction at 180° C. for 8 hours under nitrogen gas flow while removing the by-product water. The mixture is then gradually heated to 220° C. and subjected to a reaction for 4 hours under nitrogen gas flow while removing the by-product water and 1,6-hexanediol. The mixture is further subjected to a reaction under reduced pressures of from 5 to 20 mmHg until the weight average molecular weight of the reaction product reaches 6,000. Thus, a polyester diol is prepared.

A reaction vessel equipped with a condenser, a stirrer, and a nitrogen inlet pipe is charged with 269 parts of the polyester diol, 280 parts of ethyl acetate, and 12.4 parts of hexamethylene diisocyanate (HDI). The mixture is subjected to a reaction at 80° C. for 5 hours under nitrogen gas flow. The ethyl acetate is removed under reduced pressures. Thus, a crystalline polyester 2 having a weight average molecular weight of 160,000, a melting point of 72° C., and a softening temperature of 81° C. is prepared.

Preparation Example 1 of Amorphous Resin Particle

Preparation of Amorphous Polyester Resin Particle

An amorphous polyester is put into a melted state and transported to a Manton Gaulin High-pressure Homogenizer (from Gaulin) at a rate of x g/min. On the other hand, an aqueous medium tank is charged with a 0.37% diluted ammonia water prepared by diluting a reagent ammonia water with ion-exchange water. The diluted ammonia water is fed to the Manton Gaulin High-pressure Homogenizer (from Gaulin) in synchronization with the feeding of the melted amorphous polyester thereto at a rate of 0.1 liter/min while being heated to 120° C. by a heat exchanger. An emulsification treatment is performed under a pressure of 150 kg/cm$^2$. Thus, amorphous resin particles A1 to A5 are prepared. The properties of the amorphous resin particles are shown in Table 1. In Table 1, Particle Diameter refers to the average particle diameter measured by a Particle Size Distribution Analyzer LA-920 from Horiba, Ltd.

TABLE 1

| Amorphous Resin Particle No. | Amorphous Resin No. | Resin Feeding Rate x (g/min) | Particle Diameter (nm) |
|---|---|---|---|
| A1 | 1 | 40 | 20 |
| A2 | 1 | 60 | 50 |
| A3 | 1 | 80 | 90 |
| A4 | 1 | 100 | 130 |
| A5 | 2 | 60 | 50 |

Preparation Example 2 of Crystalline Resin Particle

Preparation of Crystalline Polyester Resin Particle

A crystalline polyester is put into a melted state and fed to a Manton Gaulin High-pressure Homogenizer (from Gaulin) at a rate of x g/min. On the other hand, an aqueous medium tank is charged with a 0.37% diluted ammonia water prepared by diluting a reagent ammonia water with ion-exchange water. The diluted ammonia water is fed to the Manton Gaulin High-pressure Homogenizer (from Gaulin) in synchronization with the feeding of the melted crystalline polyester thereto at a rate of 0.1 liter/min while being heated to 120° C. by a heat exchanger. An emulsification treatment is performed under a pressure of 150 kg/cm$^2$. Thus, crystalline resin particles B1 to B2 are prepared. The properties of the crystalline resin particles are shown in Table 2. In Table 2, Particle Diameter refers to the average particle diameter measured by a Particle Size Distribution Analyzer LA-920 from Horiba, Ltd.

TABLE 2

| Crystalline Resin Particle No. | Crystalline Resin No. | Resin Feeding Rate x (g/min) | Particle Diameter (nm) |
|---|---|---|---|
| B1 | 1 | 60 | 50 |
| B2 | 2 | 60 | 50 |

Example 1

Preparation of Toner 1

A toner 1 is prepared by a dissolution suspension method in the following manner.

Preparation of Solution or Dispersion Liquid of Core Materials

In a beaker, 100 parts of the amorphous polyester 1 are dissolved in 130 parts of ethyl acetate under stirring. Further, 5 parts of a carnauba wax (having a molecular weight of 1,800, an acid value of 2.5, and a penetration of 1.5 mm (at 40° C.)) and 5 parts of a master batch are added to the beaker. The beaker contents are subjected to a dispersing treatment by a bead mill (ULTRAVISCOMILL (trademark) from Aimex Co., Ltd.) filled with 80% by volume of zirconia beads having a diameter of 0.5 mm at a liquid feeding speed of 1 kg/hour and a disc peripheral speed of 6 m/sec. This dispersing operation is repeated 3 times (3 passes). Thus, a solution or dispersion liquid 1 of core materials is prepared.

Preparation of Aqueous Phase

The crystalline resin particle B1 is diluted with 660 parts of water to have a content rate of 2% by weight. By mixing 25 parts of a 48.5% aqueous solution of dodecyl diphenyl ether sodium disulfonate (ELEMINOL MON-7 from Sanyo Chemical Industries, Ltd.) and 60 parts of ethyl acetate therein, an aqueous phase (a) that is a milky liquid is obtained.

It is confirmed by optical microscope observation that the crystalline resin particle B1 can be finely dispersed without producing small aggregations having a size of several μm when the aqueous phase (a) is stirred by a TK HOMOMIXER (from Primix Corporation) at a rotation speed of 8,000 rpm. Accordingly, in a subsequent process in which the core materials is emulsified (i.e., the solution or dispersion liquid of the core material is added to the aqueous phase (a)), the crystalline resin particle B1 is dispersed into primary particles and adhered to liquid droplets of the core materials. The crystalline resin particle B1 adhered to the liquid droplets forms a second shell layer.

Preparation of Emulsion Slurry

In a vessel, 150 parts of the aqueous phase (a) is stirred by a TK HOMOMIXER (from Primix Corporation) at a rotation speed of 12,000 rpm, and 100 parts of the solution or dispersion liquid of the core materials are added thereto and mixed therewith over a period of 10 minutes. Thus, an emulsion slurry (1) is prepared.

Formation of First Shell Layer, Solvent Removal, and Fixation

The amorphous resin particle A1 is diluted with 660 parts of water to have a content rate of 2% by weight. By mixing 25 parts of a 48.5% aqueous solution of dodecyl diphenyl ether sodium disulfonate (ELEMINOL MON-7 from Sanyo Chemical Industries, Ltd.) and 60 parts of ethyl acetate therein, an aqueous phase (b) that is a milky liquid is obtained.

It is confirmed by optical microscope observation that the amorphous resin particle A1 can be finely dispersed without producing small aggregations having a size of several μm when the aqueous phase (b) is stirred by a TK HOMOMIXER (from Primix Corporation) at a rotation speed of 8,000 rpm.

Accordingly, when the emulsion slurry (1), containing the liquid droplets to which the crystalline resin B1 is adhered, is mixed in the aqueous phase (b), the amorphous resin particle A1 is dispersed into primary particles and forms a first shell layer on the second shell layer.

In a flask equipped with a degassing pipe, a stirrer, and a thermometer, 100 parts of the aqueous phase (b) and 150 parts of the emulsion slurry (1) are stirred at a rotation speed of 12,000 rpm for 10 minutes. The mixture is then exposed to reduced pressures for 12 hours at 30° C. while being stirred at a peripheral speed of 20 m/min to remove the solvent. Thus, a solvent-free slurry (2) is prepared. The solvent-free slurry (2) is heated to 60° C. to fix the resin particles on the core particle.

The solvent-free slurry (2) is let through a nylon mesh having an opening of 15 μm to remove coarse particles. The resulting slurry is then filtered under reduced pressures using an aspirator. Residues on the filter paper are finely pulverized as much as possible and then put into ion-exchange water in an amount 10 times the residue at 30° C. After being stirred and mixed for 30 minutes, the resulting slurry is filtered again under reduced pressures using an aspirator, followed by measurement of conductivity of the filtrate. This operation is repeated until the conductivity of the filtrate becomes 10 μS/cm or less. The residues having been washed are finely pulverized by a wet or dry granulator (COMIL) and then vacuum-dried in an oven at 35° C. for 36 hours. Thus, a mother toner particle is obtained.

Figure 6:
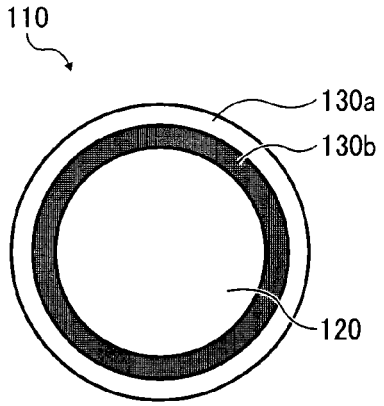
FIG. 6 is a schematic cross-sectional view of a mother toner particle obtained in Example of the present disclosure.

A schematic cross-sectional view of the mother toner particle is illustrated in FIG. 6. In FIG. 6, 110 denotes a mother toner particle, 120 denotes a core particle including an amorphous polyester, 130*a* denotes a first shell layer (i.e., outermost layer) including an amorphous polyester, and 130*b* denotes a second shell layer including a crystalline polyester.

The mother toner particle in an amount of 100 parts is mixed with 1 part of a hydrophobized silica and 0.7 parts of a hydrophobized titanium oxide by a HENSCHEL MIXER. Thus, a toner 1 is prepared.

Examples 2 to 7

Preparation of Toners 2 to 7

Toners 2 to 7 are prepared in the same manner as toner 1 except that the crystalline resin particle B1 and the amorphous resin particle A1 are replaced with other resins as shown in Table 3; the amorphous polyester 2 is used in forming the core particle in Example 7; and the crystalline polyester 2 is used in forming the second shell layer in Example 5.

TABLE 3

| Toner No. | Crystalline Resin Particle No. | Amorphous Resin Particle No. |
|---|---|---|
| 2 | B1 | A2 |
| 3 | B1 | A3 |
| 4 | B1 | A4 |
| 5 | B2 | A2 |
| 6 | B1 | A2 |
| 7 | B1 | A5 |

Example 8

Preparation of Toner 8

A toner 8 is prepared by an emulsion aggregation method in the following manner.

Preparation of Amorphous Resin Particle Dispersion Liquid (A1)

The amorphous resin particle A1 is diluted with 660 parts of water to have a content rate of 2% by weight. By mixing 25 parts of a 48.5% aqueous solution of dodecyl diphenyl ether sodium disulfonate (ELEMINOL MON-7 from Sanyo Chemical Industries, Ltd.) and 60 parts of ethyl acetate therein, an amorphous resin particle dispersion liquid (A1) that is a milky liquid is obtained.

It is confirmed by optical microscope observation that the amorphous resin particle A1 can be finely dispersed without producing small aggregations having a size of several μm when amorphous resin particle dispersion liquid (A1) is stirred by a TK HOMOMIXER (from Primix Corporation) at a rotation speed of 8,000 rpm.

Preparation of Crystalline Resin Particle Dispersion Liquid (B1)

The crystalline resin particle B1 is diluted with 660 parts of water to have a content rate of 2% by weight. By mixing 25 parts of a 48.5% aqueous solution of dodecyl diphenyl ether sodium disulfonate (ELEMINOL MON-7 from Sanyo Chemical Industries, Ltd.) and 60 parts of ethyl acetate therein, a crystalline resin particle dispersion liquid (B1) that is a milky liquid is obtained.

It is confirmed by optical microscope observation that the crystalline resin particle B1 can be finely dispersed without producing small aggregations having a size of several μm when the crystalline resin particle dispersion liquid (B1) is stirred by a TK HOMOMIXER (from Primix Corporation) at a rotation speed of 8,000 rpm.

Preparation of Wax Dispersion Liquid

The following constituents are mixed, and the mixture is subjected to a dispersing treatment by a pressure-discharge homogenizer (Gaulin Homogenizer from Gaulin). In the dispersing treatment, the wax is first dissolved by adjusting the inner liquid temperature to 120° C. and then dispersed under a dispersing pressure of 5 MPa for 10 minutes and subsequently under a dispersing pressure of 40 MPa for 350 minutes, followed by cooling. Thus, a wax dispersion liquid is prepared.

Carnauba wax (having a molecular weight of 1,800, an acid value of 2.5, and a penetration of 1.5 mm (at 40° C.)): 270 parts Anionic surfactant (NEOGEN RK from DKS Co., Ltd., having an active ingredient quantity of 60%): 13.5 parts (the ratio of the active ingredient is 3.0% based on the wax)

Ion-exchange water: 722 parts

The wax particles in the dispersion liquid have a volume average particle diameter D50v of 220 nm. A certain amount of ion-exchange water is added to the above-prepared wax dispersion liquid so as to adjust the solid content concentration to 20.0%. Thus, a wax dispersion liquid (8) is prepared.

Preparation of Aluminum Sulfate Aqueous Solution

In a vessel, 35 parts of an aluminum sulfate powder (from Asada Chemical Industry Co., Ltd., containing 17% of aluminum sulfate) and 1,965 parts of ion-exchange water are stirred and mixed at 30° C. until precipitates have disappeared. Thus, an aluminum sulfate aqueous solution is prepared.

Preparation of Toner 8

Amorphous resin particle dispersion liquid (A1): 500 parts Wax dispersion liquid (8): 60 parts Ion-exchange water: 200 parts Anionic surfactant (Dowfax 2A1 from The Dow Chemical Company): 7.0 parts In a reaction vessel equipped with a thermometer, a pH meter, and a stirrer, the above constituents are subjected to a dispersing treatment at 25° C. by a homogenizer (ULTRA-TURRAX® from IKA Japan) at a rotation speed pf 5,000 rpm, and 125 parts of the above-prepared aluminum sulfate aqueous solution is added thereto and dispersed therein over a period of 6 minutes.

After setting a stirrer and a mantle heater to the reaction vessel, the above-prepared slurry is heated to 40° C. at a heating rate of 0.2° C./min and to more than 40° C. at a heating rate of 0.05° C./min while the rotation speed of the stirrer is adjusted so that the slurry is well stirred. The slurry is subjected to a measurement of particle diameter by a MULTISIZER II (with an aperture diameter of 50 μm, from Beckman Coulter, Inc.) every 10 minutes. When the volume average particle diameter becomes 5.6 μm, the temperature rise is terminated and the slurry is maintained at this temperature. Thus, a core particle dispersion liquid containing core particles having a desired particle diameter is obtained.

To form a second shell layer, 63 parts of the crystalline resin particle dispersion liquid (B1) is mixed in the core particle dispersion liquid over a period of 5 minutes.

After the mixture has been left for 30 minutes, to form a first shell layer, 63 parts of the amorphous resin particle dispersion liquid (A1) is further mixed therein over a period of 5 minutes. After the mixture has been left for 30 minutes, a certain amount of 4% aqueous solution of sodium hydroxide is added thereto to adjust the pH to 9.0. The mixture is heated to 90° C. at a heating rate of 1° C./min and maintained at 90° C. while the pH is adjusted to 9.0 every 5° C. The resulting particles are observed with an optical microscope and a scanning electron microscope (FE-SEM) every 15 minutes to check the shape and surface property thereof. One and a half hours later, coalescence of particles is observed. Therefore, the vessel is cooled to 30° C. with cooling water over a period of 5 minutes.

The resulting slurry having been cooled is let through a nylon mesh having an opening of 15 μm to remove coarse particles. The resulting slurry is then filtered under reduced pressures using an aspirator. Residues on the filter paper are finely pulverized as much as possible and then put into ion-exchange water in an amount 10 times the residue at 30° C. After being stirred and mixed for 30 minutes, the resulting slurry is filtered again under reduced pressures using an aspirator, followed by measurement of conductivity of the filtrate. This operation is repeated until the conductivity of the filtrate becomes 10 μS/cm or less. The residues having been washed are finely pulverized by a wet or dry granulator (COMIL) and then vacuum-dried in an oven at 35° C. for 36 hours. Thus, a mother toner particle is obtained.

The mother toner particle in an amount of 100 parts is mixed with 1 part of a hydrophobized silica and 0.7 parts of a hydrophobized titanium oxide by a HENSCHEL MIXER. Thus, a toner 8 is prepared.

Examples 9 to 11

Preparation of Amorphous Resin Particle Dispersion Liquid (A2) to (A4)

Amorphous resin particle dispersion liquids (A2) to (A4) are prepared in the same manner as the amorphous resin particle dispersion liquid (A1) except for replacing the amorphous resin particle A1 with the amorphous resin particles A2 to A4, respectively.

Preparation of Toners 9 to 11

Toners 9 to 11 are prepared in the same manner as toner 8 except for replacing the amorphous resin particle dispersion liquid (A1) with the amorphous resin particle dispersion liquids (A2) to (A4), respectively.

Comparative Example 1

Preparation of Toner 12

Toner 12 is prepared in the same manner as toner 1 except that neither the aqueous phase (a), containing the crystalline resin particle B1 for forming the second shell layer, nor the aqueous phase (b), containing the amorphous resin particle A1 for forming the outermost first shell layer, is used.

Comparative Example 2

Preparation of Toner 13

Toner 13 is prepared in the same manner as toner 1 except that the aqueous phase (b), containing the amorphous resin particle A1 for forming the outermost first shell layer, is not used.

Comparative Example 3

Preparation of Toner 14

Toner 14 is prepared in the same manner as toner 1 except that the aqueous phase (b), containing the amorphous resin particle A1 for forming the outermost first shell layer, is replaced with the aqueous phase (a), containing the crystalline resin particle B1, i.e., the composition of the first shell layer is changed.

Comparative Example 4

Preparation of Toner 15

Toner 15 is prepared in the same manner as toner 1 except that the aqueous phase (a), containing the crystalline resin particle B1 for forming the second shell layer, is replaced with the aqueous phase (b), containing the amorphous resin particle A1, i.e., the composition of the second shell layer is changed.

The above-prepared toners 1 to 15 are subjected to the evaluations of the degrees of toner scattering and background fouling. The evaluation results are shown in Table 4. The method of forming core particle; the resin compositions of the core particle, first shell layer (outermost layer), and second shell layer; the thickness of the first shell layer (outermost layer); and the lower-limit fixable temperature are also shown in Table 4.

Evaluation procedures are described below.

Thickness of First Shell Layer

The thickness of the first shell layer is measured by observing a cross-sectional surface of a toner which has been dyed with ruthenium tetraoxide.

First, a toner is embedded in an epoxy resin and cut into thin sections having a thickness of 100 nm using a microtome. Here, the toner may or may not include an external additive. Alternatively, the toner may be in the form of mother toner particle from which an external additive has been removed. After being dyed with a 0.5% aqueous solution of ruthenium tetraoxide, the sections are observed with a transmission electron microscope (TEM). The first shell layer is distinguishable in the cross-sectional image of the toner owing to its color contrast.

A thickness of the first shell layer is measured at 4 specific positions on the first shell layer with respect to one toner particle where the first shell layer intersects with two straight lines intersecting one another at right angles at an approximate center of the toner particle. One hundred randomly-selected toner particles are subjected to the measurement of the thickness of the first shell layer in the above-described manner and the measurement results are averaged.

Lower-Limit Fixable Temperature

An electrophotographic copier (MF-200 from Ricoh Co., Ltd.) employing a TEFLON fixing roller is modified so that the temperature of the fixing roller is variable. Each toner is set in the copier, and a solid image having a toner deposition amount of 0.85±0.1 mg/cm$^2$ and a size of 3 cm×8 cm is formed and fixed on multiple sheets of a copier paper <70> (from Ricoh Business Expert Co., Ltd.) while varying the temperature of the fixing roller. Each of the fixed images is subjected to a drawing test using a drawing tester AD-401 (from Ueshima Seisakusho Co., Ltd.). In the drawing test, a ruby needle having an edge diameter of from 260 to 320 μm and an edge angle of 60° draws spirals on the surface of the fixed image under a load of 50 g, and then a piece of fiber HONEYCOTT #440 strongly rubs the surface 5 times. A fixing roller temperature at which the fixed image has very few scratches after the drawing test is identified as the lower-limit fixable temperature. The solid image is formed on a sheet at a position 3.0 cm apart from the leading edge of the sheet in the paper feeding direction. The sheet is passed through the nip portion of the fixing device at a speed of 280 mm/s. As the lower-limit fixable temperature gets lower, the low-temperature fixability gets better.

Toner Scattering

Each toner is set in a digital full-color printer IMAGIO COLOR 2800 (from Ricoh Co., Ltd.), and a running test is performed in which a monochrome image chart having an image area ratio of 50% is continuously formed on 50,000 sheets of paper. After the running test, the degree of toner contamination inside the copier is evaluated based on the following criteria.

AA or A: No problem in the degree of toner contamination.

B: A certain degree of toner contamination is observable, but no problem in practical use.

C: A significant degree of toner contamination is observable. Not suitable for practical use.

Background Fouling

Each toner (developer) is set in an IPSIO CX2500 (from Ricoh Co., Ltd.), and a predetermined print pattern having a B/K (Black/White) ratio of 6% is continuously printed on sheets under an N/N environment (i.e., 23° C., 45% RH).

After the continuous printing on 50 sheets and 2,000 sheets under the N/N environment and before the cleaning of the photoconductor, toner particles which are contaminating the background portion on the photoconductor are transferred onto a colorless transparent tape. The tape is adhered to a white paper sheet and subjected to a measurement of the lightness L* by a spectrodensitometer X-RITE 939 (from X-Rite). The degree of background fouling is determined based on the following criteria.

AA: L* is not less than 90.

A: L* is not less than 85 and less than 90.

B: L* is not less than 80 and less than 85.

C: L* is less than 80.

TABLE 4

| | | Core Particle | Resin Composition | | | Thickness of First Shell Layer (nm) | Evaluiation Results | | |
|---|---|---|---|---|---|---|---|---|---|
| | Toner No. | Production Method | Core Particle | First Shell layer (Outermost Layer) | Second Shell Layer | | Lowe-limit Fixable Temp. (° C.) | Toner Scattering | Background Fouling |
| Example 1 | Toner 1 | Dissolution Suspension | Amorphous Polyester 1 | Amorphous Polyester 1 | Crystalline Polyester 1 | 20 | 105 | AA | AA |
| Example 2 | Toner 2 | Dissolution Suspension | Amorphous Polyester 1 | Amorphous Polyester 1 | Crystalline Polyester 1 | 50 | 110 | AA | AA |
| Example 3 | Toner 3 | Dissolution Suspension | Amorphous Polyester 1 | Amorphous Polyester 1 | Crystalline Polyester 1 | 90 | 110 | A | A |
| Example 4 | Toner 4 | Dissolution Suspension | Amorphous Polyester 1 | Amorphous Polyester 1 | Crystalline Polyester 1 | 130 | 110 | B | B |
| Example 5 | Toner 5 | Dissolution Suspension | Amorphous Polyester 1 | Amorphous Polyester 1 | Crystalline Polyester 2 | 50 | 110 | AA | AA |
| Example 6 | Toner 6 | Dissolution Suspension | Amorphous Polyester 2 | Amorphous Polyester 1 | Crystalline Polyester 1 | 50 | 110 | AA | AA |
| Example 7 | Toner 7 | Dissolution Suspension | Amorphous Polyester 1 | Amorphous Polyester 2 | Crystalline Polyester 1 | 50 | 115 | AA | AA |
| Example 8 | Toner 8 | Emulsion Aggregation | Amorphous Polyester 1 | Amorphous Polyester 1 | Crystalline Polyester 1 | 20 | 105 | AA | AA |
| Example 9 | Toner 9 | Emulsion Aggregation | Amorphous Polyester 1 | Amorphous Polyester 1 | Crystalline Polyester 1 | 50 | 110 | AA | AA |
| Example 10 | Toner 10 | Emulsion Aggregation | Amorphous Polyester 1 | Amorphous Polyester 1 | Crystalline Polyester 1 | 90 | 110 | A | A |
| Example 11 | Toner 11 | Emulsion Aggregation | Amorphous Polyester 1 | Amorphous Polyester 1 | Crystalline Polyester 1 | 130 | 110 | B | B |
| Comparative Example 1 | Toner 12 | Dissolution Suspension | Amorphous Polyester 1 | — | — | — | 140 | AA | AA |
| Comparative Example 2 | Toner 13 | Dissolution Suspension | Amorphous Polyester 1 | — | Crystalline Polyester 1 | — | 105 | C | C |
| Comparative Example 3 | Toner 14 | Dissolution Suspension | Amorphous Polyester 1 | Crystalline Polyester 2 | Crystalline Polyester 1 | 50 | 105 | C | C |
| Comparative Example 4 | Toner 15 | Dissolution Suspension | Amorphous Polyester 1 | Amorphous Polyester 1 | Amorphous Polyester 2 | 50 | 140 | AA | AA |

The results shown in Table 4 indicate that the toners having the second shell layer including a crystalline resin and the first shell layer, being the outermost layer, including an amorphous resin have a relatively low lower-limit fixable temperature, i.e., excellent low-temperature fixability. In addition, these toners have no problem in practical use in terms of toner scattering and background fouling.

The toner of Comparative Example 1, having neither first nor second shell layers, delivers good results in toner scattering and background fouling. However, the lower-limit fixable temperature is relatively high (140° C.), i.e., low-temperature fixability is poor. With respect to the toner of Comparative Example 2, having the second shell layer including the crystalline polyester 1 but the first shell layer (outermost layer), the lower-limit fixable temperature is good. However, there is a problem in practical use in terms of toner scattering and background fouling.

With respect to the toner of Comparative Example 3, both the first and second shell layers of which including a crystalline polyester, the lower-limit fixable temperature is good. However, there is a problem in practical use in terms of toner scattering and background fouling.

The toner of Comparative Example 4, both the first and second shell layers of which including an amorphous polyester, delivers good results in toner scattering and background fouling. However, the lower-limit fixable temperature is relatively high (140° C.), i.e., low-temperature fixability is poor.

In accordance with some embodiments of the present invention, a toner which has excellent low-temperature fixability does not cause toner scattering and background fouling is provided. In addition, a developer, an image forming apparatus, and a process cartridge each including the toner are provided.

The toner according to some embodiments of the present invention achieves a good balance between heat-resistant storage stability and hot offset resistance. The toner can respond to the demand for energy saving owing to its low-temperature fixability. The toner can also respond to the strong demand for speeding-up, downsizing, colorization, and higher image quality in image forming apparatuses such as copier, laser printer, and facsimile machine.

What is claimed is:

1. A toner, comprising:

a core particle;

a second shell layer overlying the core particle, the second shell layer including a crystalline resin; and a first shell layer overlying the second shell layer and constituting an outermost layer, the first shell layer including an amorphous resin.

2. The toner according to claim 1, wherein the first shell layer has an average thickness of less than 100 nm.

3. The toner according to claim 1, wherein the crystalline resin is a crystalline polyester.

4. The toner according to claim 1, wherein the amorphous resin is an amorphous polyester.

5. A developer, comprising:

the toner according to claim 1; and a carrier.

6. A method of manufacturing the toner according to claim 1, comprising:

(I) dissolving or dispersing core materials including at least a binder resin in a solvent, thereby preparing a solution or dispersion liquid of the core materials;

(II) subjecting the crystalline resin in a melted state to an emulsification treatment along with a treatment liquid to obtain a crystalline resin particle and diluting the crystalline resin particle with a solvent including water, thereby preparing an aqueous phase (a);

(III) mixing the solution or dispersion liquid of the core materials in the aqueous phase (a), thereby preparing an emulsion slurry (1);

(IV) subjecting the amorphous resin in a melted state to an emulsification treatment along with a treatment liquid to obtain an amorphous resin particle and diluting the amorphous resin particle with a solvent including water, thereby preparing an aqueous phase (b);

(V) mixing the emulsion slurry (1) in the aqueous phase (b) and subjecting the mixture to a solvent removal treatment under reduced pressures, thereby preparing a solvent-free slurry (2); and (VI) heating the solvent-free slurry (2) to fix the crystalline resin particle and the amorphous resin particle on the core particle.

7. A method of manufacturing the toner according to claim 1, comprising:

(I) subjecting the amorphous resin in a melted state to an emulsification treatment along with a treatment liquid to obtain an amorphous resin particle and diluting the amorphous resin particle with a solvent including water, thereby preparing an amorphous resin particle dispersion liquid (A);

(II) subjecting the crystalline resin in a melted state to an emulsification treatment along with a treatment liquid to obtain a crystalline resin particle and diluting the crystalline resin particle with a solvent including water, thereby preparing a crystalline resin particle dispersion liquid (B);

(III) dispersing a wax in a water with a surfactant, thereby preparing a wax dispersion liquid;

(IV) heat-mixing the amorphous resin particle dispersion liquid (A) and the wax dispersion liquid, thereby preparing a core particle dispersion liquid containing the core particle having a desired particle diameter;

(V) mixing the crystalline resin particle dispersion liquid (B) in the core particle dispersion liquid;

(VI) mixing the amorphous resin particle dispersion liquid (A) in the mixture obtained in the process (V);

(VII) subjecting the mixture obtained in the process (VI) to a solvent removal treatment under reduced pressures, thereby preparing a solvent-free slurry (2); and (VIII) heating the solvent-free slurry (2) to fix the crystalline resin particle and the amorphous resin particle on the core particle.

8. An image forming apparatus, comprising:

a latent image bearer;

a charger to charge a surface of the latent image bearer;

an irradiator to irradiate the charged surface of the latent image bearer with light to form an electrostatic latent image thereon;

a developing device to develop the electrostatic latent image into a toner image with the toner according to claim 1;

a transfer device to transfer the toner image from the surface of the latent image bearer onto a recording medium; and a fixing device to fix the toner image on the recording medium.

9. An image forming method, comprising:

charging a surface of a latent image bearer;

irradiating the charged surface of the latent image bearer with light to form an electrostatic latent image thereon;

developing the electrostatic latent image into a toner image with the toner according to claim 1;

transferring the toner image from the surface of the latent image bearer onto a recording medium; and fixing the toner image on the recording medium.

10. A process cartridge detachably mountable on image forming apparatus, comprising:

a latent image bearer to bear an electrostatic latent image; and a developing device to develop the electrostatic latent image into a toner image with the toner according to claim 1.

* * * * *